US008794179B2

(12) United States Patent
Tsuchiya et al.

(10) Patent No.: US 8,794,179 B2
(45) Date of Patent: Aug. 5, 2014

(54) METHOD FOR MANUFACTURING PATTERN FORMED BODY

(75) Inventors: Katsunori Tsuchiya, Tokyo-to (JP); Masato Idegami, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 1018 days.

(21) Appl. No.: 12/169,713

(22) Filed: Jul. 9, 2008

(65) Prior Publication Data

US 2008/0273061 A1 Nov. 6, 2008

Related U.S. Application Data

(62) Division of application No. 11/293,455, filed on Dec. 2, 2005.

(30) Foreign Application Priority Data

Dec. 3, 2004 (JP) ..... 2004-351778

(51) Int. Cl.

| | |
|---|---|
| ***B05B 5/00*** | (2006.01) |
| ***B05C 5/00*** | (2006.01) |
| ***B05B 3/00*** | (2006.01) |
| ***B05C 5/02*** | (2006.01) |
| ***B41J 2/06*** | (2006.01) |
| ***B41J 2/07*** | (2006.01) |
| ***B41J 2/085*** | (2006.01) |
| *B41J 2/09* | (2006.01) |
| *B41J 2/035* | (2006.01) |
| *B05B 17/00* | (2006.01) |
| *B05D 1/26* | (2006.01) |

(52) U.S. Cl.

CPC ..... *B05C 5/02* (2013.01); *B05C 5/0225* (2013.01); *B41J 2/06* (2013.01); *B41J 2/085* (2013.01); *B41J 2/09* (2013.01); *B41J 2/035* (2013.01); *B05B 17/00* (2013.01); *B05D 1/26* (2013.01)

USPC ..... 118/629; 118/624; 118/300; 118/323; 347/74; 347/75; 347/76; 347/77

(58) Field of Classification Search

CPC ..... B05C 5/02; B05C 5/0225; B41J 2/06; B41J 2/085; B41J 2/09

USPC ..... 118/629, 642, 624, 300, 323; 347/55, 347/74–77, 82

See application file for complete search history.

(56) References Cited

U.S. PATENT DOCUMENTS 3,911,448 A 10/1975 Ohno et al.
3,928,718 A * 12/1975 Sagae et al. ..... 358/296

(Continued)

FOREIGN PATENT DOCUMENTS

JP 55-109673 A 8/1980
JP 2000-246887 A 9/2000

(Continued)

OTHER PUBLICATIONS

USPTO OA mailed Jan. 21, 2010 in connection with U.S. Appl. No. 11/293,455.

(Continued)

*Primary Examiner* — Dah-Wei D Yuan
*Assistant Examiner* — Binu Thomas
(74) *Attorney, Agent, or Firm* — Ladas & Parry LLP

(57) ABSTRACT

The main object of the present invention is to provide a method for manufacturing a pattern formed body by the electric field jet method, capable of stabilizing the discharge amount and the discharge direction of a liquid. The present invention achieves the object by providing a method for manufacturing a pattern formed body characterized in that a pattern is formed on a substrate by: discharging a liquid from a discharge orifice by applying a voltage between a first electrode, disposed in the vicinity of the discharge orifice of a nozzle of a discharge head, and a second electrode, disposed in between the discharge orifice and the substrate, having an opening for discharge; and adhering the liquid onto the substrate by passing through the opening for discharge of the second electrode.

4 Claims, 6 Drawing Sheets

(56) References Cited

U.S. PATENT DOCUMENTS

| | | | | |
|---|---|---|---|---|
| 3,968,498 | A * | 7/1976 | Uchiyama | 118/663 |
| 4,065,773 | A * | 12/1977 | Berry | 347/15 |
| 4,215,353 | A * | 7/1980 | Kaieda et al. | 347/55 |
| 4,246,589 | A | 1/1981 | Denny et al. | |
| 4,281,333 | A | 7/1981 | Tsuzuki et al. | |
| 4,367,476 | A | 1/1983 | Sagae | |
| 4,383,265 | A | 5/1983 | Kohashi | |
| 4,394,663 | A * | 7/1983 | Ameyama | 347/76 |
| 4,413,265 | A | 11/1983 | Kockler et al. | |
| 4,647,945 | A | 3/1987 | Andeen et al. | |
| 4,723,129 | A | 2/1988 | Endo et al. | |
| 4,725,852 | A | 2/1988 | Gamblin et al. | |
| 4,734,705 | A | 3/1988 | Rezanka et al. | |
| 5,402,164 | A * | 3/1995 | Mutoh | 347/81 |
| 5,489,929 | A | 2/1996 | Vago | |
| 5,546,108 | A | 8/1996 | Hotomi et al. | |
| 5,661,509 | A * | 8/1997 | Dochovna | 347/14 |
| 6,130,691 | A * | 10/2000 | Takemoto et al. | 347/55 |
| 6,146,567 | A * | 11/2000 | Sachs et al. | 264/113 |
| 6,158,844 | A | 12/2000 | Murakami et al. | |
| 6,247,800 | B1 * | 6/2001 | Mutoh | 347/74 |
| 6,280,799 | B1 | 8/2001 | Okabe et al. | |
| 7,249,828 | B2 * | 7/2007 | Gelbart et al. | 347/74 |
| 2006/0163759 | A1 | 7/2006 | Maruyama et al. | |

FOREIGN PATENT DOCUMENTS

| | | | |
|---|---|---|---|
| JP | 2002-126615 | A | 5/2002 |
| JP | 2003-011375 | A | 1/2003 |
| JP | 2005-000910 | A | 1/2005 |

OTHER PUBLICATIONS

USPTO OA mailed May 13, 2008 in connection with U.S. Appl. No. 11/293,455.
USPTO OA mailed Oct. 16, 2008 in connection with U.S. Appl. No. 11/293,455.
USPTO OA mailed Jul. 7, 2009 in connection with U.S. Appl. No. 11/293,455.
USPTO OA mailed Oct. 14, 2010 in connection with U.S. Appl. No. 11/293,455.
European Search Report: EP 05 25 7445.
USPTO OA mailed Mar. 25, 2011 in connection with U.S. Appl. No. 11/293,455.

* cited by examiner

METHOD FOR MANUFACTURING PATTERN FORMED BODY

BACKGROUND OF THE INVENTION

1. Field of the Invention

The present invention relates to a method for manufacturing a pattern formed body in which liquid is discharged and adhered onto a substrate by applying a voltage.

2. Description of the Related Art

A method, in which liquid is discharged from a nozzle like or slit like discharge orifice onto a substrate and is adhered, is used widely for graphics or various kinds of markings. As an example of such a method, the ink jet method, the dispenser method, or the like can be presented. These methods are advantageous in that the apparatus is simple, the cost of the material can be reduced, or the like compared with the conventional printing method or photolithography method. Recently, many attempts have been made for producing the members requiring minute patterning, such as a color filter for a liquid crystal display, by applying these methods.

The ink jet method is a method for forming a pattern by discharging and throwing small droplets of an ink from a minute discharge orifice so as to be adhered directly onto a substrate such as a paper. General principles for discharge are as follows: the piezoelectric system in which shape of the ink channel is changed by the vibration of a piezoelectric element so as to discharge an ink; and the thermal system in which bubbles are formed in an ink by the heat from a heat generating member in an ink channel and the ink is discharged by the pressure. In the ink jet method, development is executed vigorously for the purpose of making the liquid droplets smaller and stabilizing the landing of the liquid droplet. Nowadays, in the piezoelectric system ink jet method, the droplets small as 2 picoliters can be discharged.

However, as a serious problem of the ink jet method, only an extremely low viscosity ink of 50 cps or less viscosity can be discharged. Therefore, the solid component density in the ink cannot be made higher so that a plurality of liquid droplets are need to be superimposed in order to obtain a film thickness necessary in terms of the function. Moreover, the low viscosity ink is widely spread on the substrate surface after landing thereon, so that it has been problematic in terms of the fine pattern formation. Although a certain effect can be obtained by providing an ink absorbing layer on the surface of the substrate, it limits the field of application in not only the cost, but also in functions.

On the other hand, in the dispenser method, a high viscosity liquid can be discharged and adhered in lines or in dots. By making the inner diameter of the nozzle smaller, a narrower line or smaller dot can be discharged. Presently, a minute nozzle of about a 20 μm inner diameter is commercially available. Although it depends on the liquid viscosity, a minute patterning of about 30 μm is possible.

However, in the dispenser method, since liquid droplets smaller than the nozzle inner diameter cannot be discharged, the nozzle inner diameter always must be made smaller for a minute patterning. Therefore, for discharging a high viscosity liquid, an extremely high pressure must be applied. Moreover, particularly in the case of a high viscosity liquid, the gap between the nozzle and the substrate must be made smaller so that it is difficult to provide an apparatus so as to provide a cause of a problem.

Furthermore, as a common problem for the ink jet method and the dispenser method, in the both methods, since the nozzle inner diameter needs to be made smaller to the 10 μm order in order to discharge minute liquid droplets, an ink obtained by dispersing particles of large diameter, such as a fluorescent substance, a glass frit, a photoluminescent pigment, a magnetic substance, can hardly be discharged stably due to the problem of the clogging.

Accordingly, the present inventors have discussed the various aspects of a method for forming a minute pattern using an high viscosity ink or an ink including large particles so as to achieve the invention of the electric field jet method (for example, see Japanese Patent Application Laid-open (JP-A) Nos. 2000-246887 and No. 2002-126615). The electric field jet method is a method, in general, in which an ink is supplied to a discharge head having a nozzle like or slit like discharge orifice provided with electrodes in the vicinity thereof, and then, the ink is discharged continuously or intermittently from the discharge orifice by applying an alternating voltage or a direct voltage to the above-mentioned electrode.

In the electric field jet method, not only a high viscosity ink of several tens of thousand cps can be discharged like a dispenser, but a low viscosity ink of several cps or less can also be discharged as well. It is the largest characteristic of the electric field jet method that the tip diameter of the ink to be discharged can be made smaller than the nozzle inner diameter, owing to the electric field effect. Depending on the combination of the ink and the discharge head, the size of the line or the dot to be patterned can be made smaller to 1/10 or less of the nozzle inner diameter. Also, since the nozzle inner diameter can be made relatively large according to the objective pattern, an ink including large particles can be discharged stably with a high resolution without clogging.

However, since the electric field jet method is extremely sensitive to the influence of the substrate surface, even though stable discharge is possible on an even substrate such as a raw glass, in the case of a substrate with uneven surface or a substrate having a conductivity difference, it has been extremely difficult to land the ink on a desired position because of the act of a force to make the liquid land on the higher part of the unevenness or on a part of higher conductivity. Moreover, even though it can be improved by adjusting the conductivity of the liquid or by optimizing the applied voltage, it has its own limit so that the discharge onto a substrate with unevenness or the stable discharge onto a substrate already provided with a conductive pattern can hardly be achieved.

SUMMARY OF THE INVENTION

The present invention has been achieved in view of the above-mentioned problems, and the main object thereof is to provide a method for manufacturing a pattern formed body by the electric field jet method, capable of stabilizing the discharge amount and the discharge direction of a liquid.

As a result of the elaborate discussion of the above-mentioned present circumstances by the present inventors, it as been found out that a discharged liquid can be landed on a predetermined position without suffering the influence of the substrate by providing a second electrode, in between the discharge orifice of the discharge head and the substrate, upon discharging the liquid by the electric field jet method, so as to complete the present invention.

That is, the present invention provides a method for manufacturing a pattern formed body characterized in that a pattern is formed on a substrate by: discharging a liquid from a discharge orifice by applying a voltage between a first electrode, disposed in the vicinity of the discharge orifice of a nozzle of a discharge head, and a second electrode, disposed in between the discharge orifice and the substrate, having an opening for discharge; and adhering the liquid onto the substrate by passing through the opening for discharge of the second electrode.

When a liquid is discharged from the discharge head while applying a voltage, the meniscus of the liquid formed on the nozzle tip of the discharge head is deformed, by the applied voltage, into a tip-sharpened conical shape. And then, the tip of the conical shape is stretched so as to reach at the substrate surface, and a liquid column of the liquid is formed. Therefore, the liquid is discharged in the liquid column state. In the present invention, due to the effect of the electric field, the tip diameter of the liquid column of the liquid, discharged from the discharge orifice of the discharge head, can be made same as or narrower than the aperture diameter of the discharge orifice of the discharge head.

Moreover, since the second electrode is disposed in between the discharge orifice and the substrate, even when the liquid is discharged onto a substrate with uneven surface or a substrate having a conductivity difference, straight-going property of the discharge can be maintained without being attracted to the projecting portion of the unevenness or the portion having a high conductivity. Furthermore, even when a successive liquid is discharged to a position adjacent to the preliminarily discharged liquid, straight-going property of the discharge can be maintained without being attracted to the prior liquid.

Therefore, in the present invention, a minute pattern can be formed accurately and efficiently.

In the above-mentioned invention, the liquid may be discharged from the discharge orifice by controlling the pressure applied to the liquid. By controlling the pressure applied to the liquid, in addition to the application of the voltage between the first electrode and the second electrode, the control of the liquid discharge can be facilitated. Furthermore, by controlling the pressure applied to the liquid, the control of the liquid discharge amount is possible.

Moreover, in the invention, it is preferable that the liquid discharge amount is controlled by controlling the voltage applied to the first electrode and the second electrode. Thereby, the control of the various discharge amounts is possible.

Furthermore, in the present invention, the liquid discharge direction may be controlled by controlling the relative position of the discharge orifice and the opening for discharge of the second electrode. Thereby, an objective pattern can be formed only by changing the relative position of the discharge orifice and the opening for discharge of the second electrode. Moreover, a liquid can be adhered onto the side surface of the substrate.

Moreover, the present invention provides a method for manufacturing a pattern formed body characterized in that a pattern is formed on a substrate by adhering a liquid, discharged from a discharge orifice of a nozzle of a discharge head, onto the substrate by passing through an opening for discharge of a second electrode, and the liquid discharge amount is controlled by: applying a voltage between a first electrode disposed in the vicinity of the discharge orifice and the second electrode disposed between the discharge orifice and the substrate; and controlling the voltage applied to the first electrode and the second electrode.

In the present invention, not limited to the electric field jet method, the liquid discharge amount can be controlled by controlling the voltage applied to the first electrode and the second electrode, also when the liquid is discharged by various discharge methods such as the ink jet method and the dispenser method.

Furthermore, the present invention provides a method for manufacturing a pattern formed body characterized in that a pattern is formed on a substrate by adhering a liquid, discharged from a discharge orifice of a nozzle of a discharge head, onto the substrate by passing through an opening for discharge of a second electrode, and the liquid discharge direction is controlled by: applying a voltage between a first electrode disposed in the vicinity of the discharge orifice and the second electrode disposed between the discharge orifice and the substrate; and controlling the relative position of the discharge orifice and the opening for discharge of the second electrode.

In the present invention, not limited to the electric field jet method, the liquid discharge direction can be controlled by controlling the relative position of the discharge orifice and the opening for discharge of the second electrode, also when the liquid is discharged by various discharge methods such as the ink jet method and the dispenser method.

Furthermore, in the present invention, it is preferable that the liquid contains a fluorescent substance, and the method for manufacturing a pattern formed body of the present invention is applied for a plasma display panel, an electroluminescent display panel or a field emission display panel. Or it is preferable that: the liquid contains a coloring agent, and the method for manufacturing a pattern formed body of the present invention is applied for a color filter for a liquid crystal display; the liquid contains a black coloring agent, and the method for manufacturing a pattern formed body of the present invention is applied for a black matrix for a liquid crystal display; or the liquid contains a conductive substance, and the method for manufacturing a pattern formed body of the present invention is applied for an electrode.

Moreover, the present invention provides a liquid discharge device comprising: a discharge head having a supply port, a nozzle for discharging a liquid supplied from the supply port from a discharge orifice, and a first electrode disposed in the vicinity of the discharge orifice; a second electrode, disposed with a predetermined gap in the discharge direction of the liquid with respect to the discharge head, having an opening for discharge; a voltage control section for controlling the voltage applied to the first electrode and the second electrode; and a stage, for fixing the substrate, disposed so that the stage is facing to the discharge head, characterized in that the discharge head and the stage can be moved relatively, and the liquid is discharged onto the substrate while applying a voltage between the first electrode and the second electrode, by passing through the opening for discharge of the second electrode.

In the present invention, since the second electrode is disposed in the liquid discharge direction with respect to the discharge head, stable discharge is always possible regardless of the substrate surface state or of the pattern to be formed.

In the above-mentioned invention, it is preferable that the voltage control section comprises: a first voltage control section connected to the first electrode, which controls the voltage applied to the first electrode; and a second voltage control section connected to the second electrode, which controls the voltage applied to the second electrode, and the liquid discharge amount is controlled by controlling the voltage applied to the first electrode and the second electrode. Since the applied voltage can optionally be changed by both of the first voltage control section and the second voltage control section, the control of the various discharge amount is possible.

Moreover, in the present invention, the discharge head and the second electrode may have a moving means for changing the relative position, and in this case, it is preferable that the moving means controls the liquid discharge direction by controlling the relative position of the discharge orifice of the discharge head and the opening for discharge of the second electrode. Thereby, an objective pattern can be formed only by changing the relative position of the discharge orifice and the opening for discharge of the second electrode. Moreover, a liquid can be adhered onto the side surface of the substrate.

Furthermore, in the present invention, it is preferable that the voltage control section discharges a liquid from the discharge orifice by applying a voltage between the first electrode and the second electrode. Since the liquid meniscus can be deformed by the effect of the electric field, a minute pattern can be formed easily.

Moreover, the liquid discharge device of the present invention may comprise a pressure control section for controlling the pressure applied to the liquid. By controlling the pressure to the liquid by the pressure control section, on/off of the liquid discharge or the liquid discharge amount can be controlled.

According to the present invention, since the second electrode is disposed between the discharge orifice of the discharge head and the substrate, the effect that the stable discharge is always possible, regardless of the surface state of the substrate or the pattern to be formed, can be obtained. Thereby, a minute pattern can be formed accurately and efficiently.

DETAILED DESCRIPTION OF THE INVENTION

Figure 1:
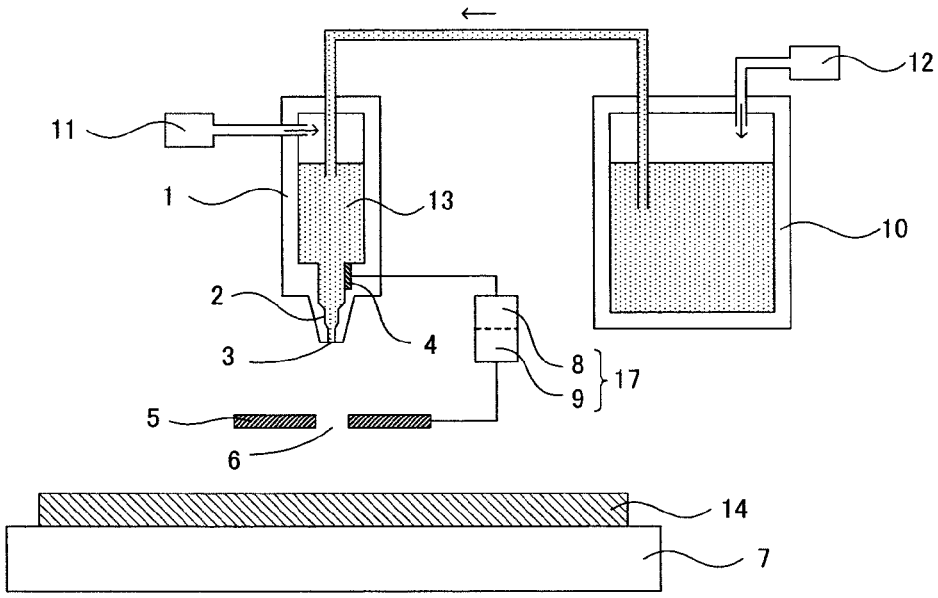
FIG. 1 is a schematic diagram showing an example of a liquid discharge device of the present invention.

Hereinafter, a method for manufacturing a pattern formed body and a liquid discharge device of the present invention will be explained in detail.

A. Method for Manufacturing Pattern Formed Body

First, a method for manufacturing a pattern formed body of the present invention will be explained. The method for manufacturing a pattern formed body of the present invention can be classified into three embodiments according to the controlling methods of the liquid discharge. The first embodiment of the method for manufacturing a pattern formed body of the present invention is a method in which on/off of the liquid discharge is controlled by applying the voltage between the first electrode and the second electrode. Moreover, the second embodiment of the method for manufacturing a pattern formed body of the present invention is a method in which the liquid discharge amount is controlled by controlling the voltage applied to the first electrode and the second electrode. Furthermore, the third embodiment of the method for manufacturing a pattern formed body of the present invention is a method in which the liquid discharge direction is controlled by controlling the relative position of the discharge orifice and the opening for discharge of the second electrode.

Hereinafter, each embodiment will be explained in detail.

1. First Embodiment

The first embodiment of the method for manufacturing a pattern formed body of the present invention is characterized in that a pattern is formed on a substrate by: discharging a liquid from a discharge orifice by applying a voltage between a first electrode, disposed in the vicinity of the discharge orifice of a nozzle of a discharge head, and a second electrode, disposed in between the discharge orifice and the substrate, having an opening for discharge; and adhering the liquid onto the substrate by passing through the opening for discharge of the second electrode.

In the present embodiment, the liquid is discharged from the discharge orifice of the nozzle of the discharge head onto the surface of the substrate while applying a voltage to the liquid. Specifically, disposing an electrode in the vicinity of the discharge orifice of the discharge head, supplying a liquid to this discharge head, and then, while applying a voltage by supplying a direct current or an alternative current to the discharge head, the above-mentioned liquid is discharged from the discharge orifice continuously or intermittently.

When a liquid is discharged from the discharge head while applying a voltage, the meniscus of the liquid formed on the nozzle tip of the discharge head is deformed, by the applied voltage, into a tip-sharpened conical shape. And then, the tip of the conical shape is stretched so as to reach at the substrate surface, and a liquid column of the liquid is formed. Therefore, the liquid is discharged in the liquid column state. It is believed that the deformation of the meniscus is generated by a potential gradient generated within the meniscus acting as the driving force. In the present embodiment, due to the effect of the electric field, the tip diameter of the liquid column of the liquid, discharged from the discharge orifice of the discharge head, can be made same as or narrower than the aperture diameter of the discharge orifice of the discharge head. Depending on the combination of the liquid and the discharge head, the size of the line or the dot to be patterned can be made smaller to 1/10 or less of the aperture diameter of the discharge orifice. Also, since the discharge orifice can be made relatively large, with respect to the objective size, a liquid including large particles such as fluorescent particles, or a liquid with high viscosity can be discharged stably with a high resolution without clogging.

Such a liquid discharge method is referred to as the electric field jet method in the present invention. In the case a liquid is discharged by the electric field jet method, the straight-going property of the liquid column of the discharged liquid may hardly be obtained when a voltage is applied. As the cause thereof, the following two reasons can be presumed.

a) Substantially same voltage is applied to the liquid which has reached the substrate surface and the liquid which is about to reach the substrate surface subsequently, so that repulsive force is generated with respect to the liquid which is about to reach the substrate surface subsequently.

b) Since the surface potential of the liquid column of the liquid elongating from the discharge orifice onto the substrate surface without interruption is high, electrostatic induction is generated with respect to the surrounding substance (for example, a projecting structure such as a rib provided on the substrate surface, a pattern formed preliminarily, a liquid discharged preliminarily, or the like) so as to form an effective electric field between the subsequent liquid column and the surrounding substance and generate the attracting force.

Therefore, in the present embodiment, discharge is controlled by disposing a second electrode, having the opening for discharge, in between the discharge orifice of the discharge head and the substrate, and passing the discharged liquid through the opening for discharge of the second electrode. Since a liquid having a high electric conductivity generates the attracting force with respect to the second electrode, the liquid is attracted to the second electrode so as to stabilize the straight-going property of the liquid discharge. Moreover, by adequately setting the relative position of the opening for discharge of the second electrode with respect to the discharge orifice, the discharged liquid can be passed through the opening for discharge of the second electrode. Thereafter, it is considered that the liquid reaches on the substrate surface by the inertia. Thereby, it can be presumed that the influence of the above-mentioned straight-going property inhibiting causes a) and b) are restrained.

Moreover, for example, in the case a pattern is formed by discharging two or more kinds of liquids in the same coating area, in principle, there is no need of drying for each liquid, so that the process can be dramatically simplified. However, in reality, when the second liquid is discharged, to the position extremely close to the first liquid pattern, before the first liquid pattern is dried, the liquid column of the second liquid may be attracted to the first liquid pattern so as to be mixed in some cases.

For example, in the case of forming a fluorescent substance of a plasma display panel (PDP), when the second color liquid is discharged without drying the first color liquid pattern, the second color liquid is attracted to the first color liquid pattern so as to generate the color mixture. As a method for preventing this phenomenon, color mixture can be prevented by setting the nozzle in a direction going away from the first color liquid pattern, and discharging the second color liquid using this nozzle (in other words, by discharging the second color liquid to the direction going away from the preliminarily formed undried pattern). However, according to the method, since the discharge is carried out toward the obliquely downward direction instead of the vertical direction, the paste filling state in the cell is likely to be left-right asymmetry. Furthermore, at the time of discharging the third color liquid, since the attracting force is applied from the both sides, this method cannot be used. Accordingly, in the case of forming a minute pattern by discharging two or more kinds of liquids, each liquid needs to be dried for each discharge, as in the case of the other methods such as the screen printing method, so that the process cannot be simplified.

In contrast, in the present embodiment, as mentioned above, by providing the second electrode having the opening for discharge, in between the discharge orifice of the discharge head and the substrate, and adequately setting the relative position of the opening for discharge of the second electrode with respect to the discharge orifice, straight-going property of the liquid discharge can be stabilized. Thereby, even before drying the prior liquid pattern, the subsequent liquid can be discharged with a good straight-going property, without being mixed with the prior liquid pattern so that the objective pattern can be formed.

The method for manufacturing a pattern formed body of the present embodiment is based on the above-mentioned principle so that a minute pattern can be formed by continuously discharging two or more kinds of liquids without providing a drying step therebetween.

Moreover, the present embodiment is more advantageous than the dispenser in that the discharge orifice can be provided relatively largely with respect to the objective size. And thus, it is suitable for discharging a liquid containing large particles, such as fluorescent powders, or a high viscosity liquid. Moreover, in the present embodiment, not only a high viscosity liquid can be discharged as in the case of the dispenser, but also discharge can be carried out for a liquid of several cps or less, as well.

FIG. 1 schematically shows an example of a liquid discharge device used in the present embodiment. A discharge head 1 comprises a nozzle 2, and a discharge orifice 3 is provided on the tip of the discharge head 1. A storage tank 10 is connected to the discharge head 1, and the storage tank 10 stores a liquid 13 and supplies the same to the discharge head 1. An air pump 12 is connected to the storage tank 10, and the liquid 13 is supplied to the discharge head 1 by applying a pressure to the surface of the liquid 13 in the storage tank 10 by the air supplied from the air pump 12. To the discharge head 1, a pressure control section 11 is connected, and a back pressure P is applied to the surface of the liquid 13 in the discharge head 1 by the air supplied from the pressure control section 11. A first electrode 4 is provided on the inner wall of the nozzle 2 of the discharge head 1, and a first voltage control section 8 is connected to the first electrode 4. The nozzle 2 is narrowed toward the position of the discharge orifice 3 so as to alleviate the resistance of the liquid at the nozzle. Moreover, a second electrode 5 is disposed in the liquid discharge direction of the discharge head 1. The second electrode 5 has an opening for discharge 6 for passing a liquid through it, and a second voltage control section 9 is connected thereto. The first voltage control section 8 and the second voltage control section 9 are provided integrally as a voltage control section 17. Furthermore, a stage 7 for fixing a substrate 14 is disposed facing to the discharge head 1.

Figure 2:
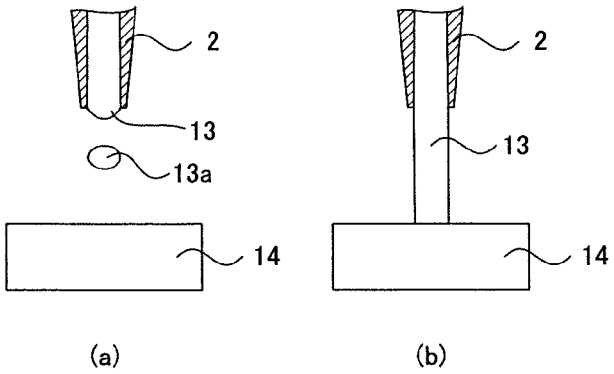
FIG. 2 is a diagram showing a state of a discharge being carried out without applying voltage.

From the nozzle of such a discharge head, a liquid can be discharged by the function of the back pressure, without the need of applying a voltage to the liquid in the nozzle. However, in the case a voltage is not applied, under a condition of a little discharge amount as shown in FIG. 2A, a desired pattern cannot be formed since the liquid 13 is not discharged continuously but it is discharged intermittently onto the surface of the substrate 14 as liquid droplets 13*a* of random sizes. On the other hand, under a condition of a large discharge amount as shown in FIG. 2B, since the liquid 13 is discharged as a liquid column of a size same as or larger than the aperture diameter of the discharge orifice, a minute pattern cannot be formed.

Figure 3:
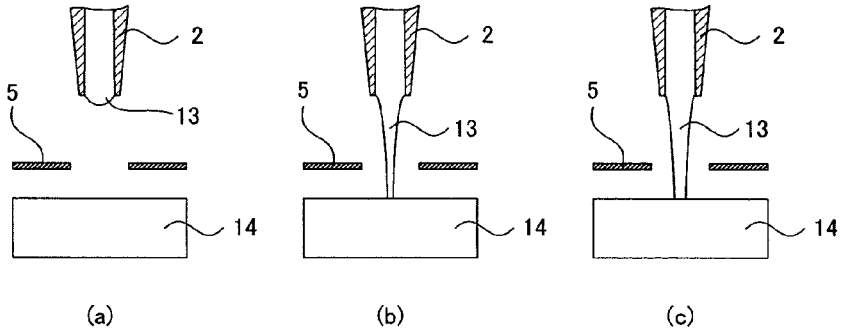
FIG. 3 is a diagram showing a state of a discharge in the present invention.

In contrast, in the case an electric current is supplied from the first voltage control section to the first electrode disposed at the nozzle of the discharge head, the electric potential gradation is induced to the liquid at the nozzle tip so that the meniscus of the liquid 13, which has been dome-like shape as shown in FIG. 3A before the voltage application, will be conical shape as shown in FIG. 3B so that the liquid is narrower than the aperture diameter of the discharge orifice, and furthermore, the liquid is discharged straightly toward the purposed discharge direction. Thereby, a minute pattern can be formed accurately by moving the discharge head or the substrate. In the case a voltage is applied, under a condition of a small discharge amount as shown in FIG. 3B, and under a condition of a large discharge amount as shown in FIG. 3C, the size of the column of the discharged liquid 13 is fluctuated according to the discharge amount determined by the promoting force, such as the voltage applied between the first electrode and the second electrode or the back pressure applied to the liquid. However, in either case, the liquid is discharged in a state narrower than the aperture diameter or the aperture width of the discharge orifice. In the present embodiment, the liquid can be discharged straightly using the discharge head by a narrowness of 1/1 to 1/1,000 of the aperture diameter or the aperture width of the discharge orifice.

Figure 4:
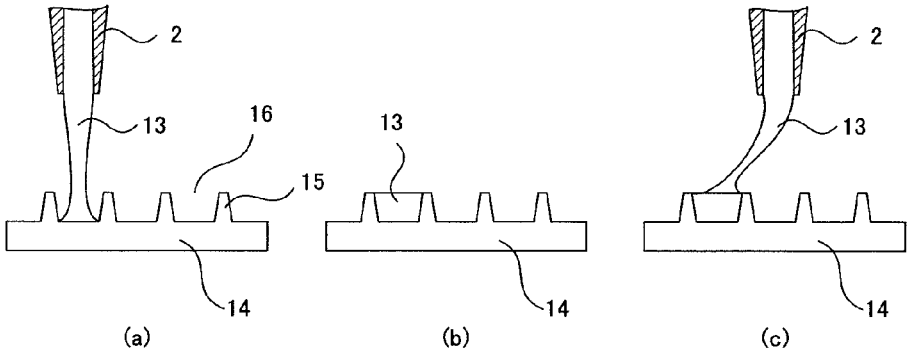
FIG. 4 is a diagram showing a state of a discharge being carried out without applying voltage.
Figure 5:
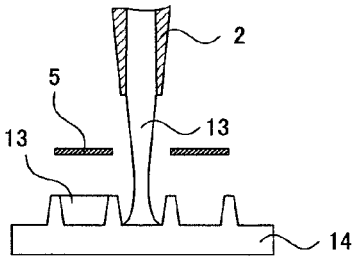
FIG. 5 is a diagram showing a state of a discharge in the present invention.

FIGS. 4 and 5 show the state of discharging a fluorescent substance paste (liquid) of each color for forming a fluorescent substance of a PDP panel. As shown in FIG. 4A, by the first discharge to one of a plurality of groove-like cells 16, each sectioned by barrier ribs 15 on the substrate 14 and provided adjacently, the liquid 13 is discharged from the nozzle 2 into an objective cell. And as shown in FIG. 4B, a predetermined cell is filled with the first liquid 13 so as to form a linear pattern. Then, by carrying out the second and latter discharges to a cell adjacent to the prior undried pattern before drying the pattern of the liquid discharged onto the substrate surface preliminarily, as shown in FIG. 4C, from the discharge from the discharge orifice of the nozzle 2 until reaching at the substrate 14 surface, the subsequent liquid 13 may be attracted to the prior undried pattern adjacent thereto so as to be landed on the undried pattern. Such a phenomenon is also generated in the case of discharging a liquid for two or more times onto a flat substrate not provided with cells.

In contrast, in the present embodiment, by disposing the second electrode 5 in between the discharge orifice of the nozzle 2 and the substrate 14 as shown in FIG. 5, the discharge direction fluctuation of the liquid 13 can be prevented so that the second and latter liquids 13 can also be discharged onto objective cells.

Moreover, as mentioned above, even in the case subsequent liquid is discharged before drying the pattern of the preliminarily discharged liquid, it can be discharged straightly in the targeted direction, without being attracted to the prior liquid pattern. Therefore, the subsequent liquid pattern can be formed accurately adjacent to the prior liquid pattern, in a gap of the prior liquid patterns, or on the prior liquid pattern. By drying the all patterns at one time after forming the patterns of the liquids accordingly, a pattern formed body with the patterns, in which patterns of each liquid exist as being a mixture or being adjacently positioned, while maintaining a predetermined positional relationship with each other, can be obtained.

Hereinafter, each configuration of the method for manufacturing a pattern formed body of the present embodiment will be explained.

(1) Voltage Application

In the present embodiment, the liquid is discharged by applying a voltage between the first electrode and the second electrode, and the liquid reaches on the substrate surface by the promoting force thereof. Since the second electrode used in the present embodiment always has a constant surface state, unlike the substrate, stable discharge is always possible regardless of the substrate surface state (a projecting structure such as a rib, a preliminarily formed pattern, a preliminarily discharged liquid, or the like) or the pattern to be formed.

Accordingly, in the present embodiment, since the stable discharge is made possible by disposing the second electrode, it is only necessary that the second electrode be grounded. Furthermore, since it is only necessary that a voltage be applied between the first electrode and the second electrode, the liquid can be discharged by applying the voltage only to the first electrode. However, it is preferable to apply a voltage also to the second electrode. Thereby, the liquid discharge can easily be controlled.

That is, in the present invention, as mentioned above, since the meniscus of the discharged liquid can be deformed by the effect of the electric field and the electric field intensity influences the liquid discharge, on/off of the discharge or the discharge amount can be controlled by controlling the voltage applied to the first electrode and the second electrode. In this case, by changing the voltage applied to the first electrode and the second electrode relatively, on/off of the discharge or the discharge amount can be controlled. At the time, both of the voltage applied to the first electrode and the voltage applied to the second electrode may be changed, the voltage applied to the first electrode may be constant, or the voltage applied to the second electrode may be constant. Moreover, in the case of applying a direct current voltage, on/off of the discharge or the discharge amount can be controlled by changing the voltage intensity. In the case an alternative current voltage, on/off of the discharge or the discharge amount can be controlled by changing the voltage intensity or the phase.

In the case of controlling on/off of the discharge by changing the voltage intensity, there are following cases. For example, by applying a voltage, which is the same intensity and the same polarity as the first electrode, to the second electrode, the liquid discharge is stopped. Moreover, by constantly applying a voltage, whose intensity is slightly insufficient for discharging the liquid, to the first electrode, and applying a weak voltage, whose polarity is opposite to the first electrode, to the second electrode, on/off of the discharge can be controlled by a weak voltage.

Moreover, in the case of controlling on/off of the discharge by the phase change, there is a following case. In the case of applying an alternative current voltage to the first electrode, for example, the electric field intensity can be controlled by applying a voltage to the second electrode, which is the same frequency and the same intensity as the voltage applied to the first electrode, and shifting the phase. At the time, by shifting the phase by 180°, since the potential difference between the first electrode and the second electrode becomes zero, so that the liquid discharge is stopped.

On the other hand, in the case of controlling the discharge amount by the voltage intensity change, there is a following case. For example, by applying a voltage, whose polarity is opposite to the first electrode, to the second electrode, the discharge amount is increased. And by applying a voltage, whose polarity is the same as the first electrode, to the second electrode, the discharge amount is decreased.

Moreover, in the case of controlling the discharge amount by the phase shift, there is a following case. In the case of controlling the electric field intensity by shifting the phase as mentioned above, since the actual voltage is made smaller when the phase is shifted, the discharge amount is decreased.

In the present embodiment, the liquid may be discharged continuously or intermittently (on/off discharge). In the case of discharging the liquid continuously, a linear pattern can be formed. Moreover, in the case of discharging the liquid intermittently, a dot like pattern can be formed. In a case of discharging the liquid continuously and in a case of discharging the liquid intermittently, the preferable voltage applying method differs.

Hereinafter, the continuously discharge and the intermittent discharge will be explained separately.

(i) Continuous Discharge

The continuous discharge is possible by applying either of the alternative voltage or direct voltage. However, it is preferable to apply an alternative voltage in terms of the discharge stability. At the time, it is preferable that the applied voltage has a steep voltage change as in the case of a rectangular wave.

Figure 6:
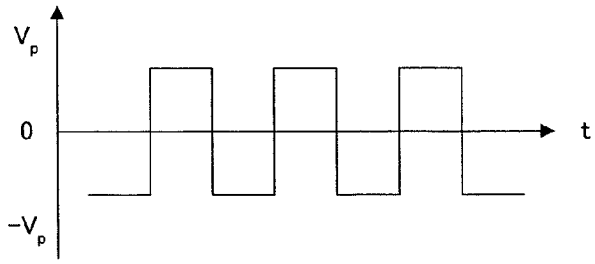
FIG. 6 is a diagram for explaining applied voltage in a case of continuous discharge.

As to the voltage intensity of the alternative voltage to be applied to the first electrode, it is preferable that $V_{p-p}$ shown in FIG. 6 is in a range of 100 V to 10 kV in terms of the voltage control and the discharge stability. In particular, since the optimum voltage intensity differs depending on the aperture diameter of the discharge orifice, physical properties of the liquid, surface state or material of the substrate, it is preferable to determine the same experimentally beforehand. As its tendency, with a smaller aperture diameter of the discharge orifice and a higher conductivity of the liquid or the substrate, the optimum voltage intensity becomes lower. On the other hand, as the voltage intensity of the direct voltage to be applied to the first electrode, in either polarity, it is preferably in a range of ±100 V to 10 kV.

Moreover, the voltage intensity to be applied to the second electrode is selected optionally according to the above-mentioned voltage intensity applied to the first electrode.

The optimum range of the frequency of the applied voltage in the continuous discharge is determined mainly according to the electric conductivity of the liquid. However, it is also influenced by the other factors such as the liquid viscosity and the material composition. In many cases, as the electric conductivity rises, the optimum frequency of the applied voltage becomes higher. When the frequency of the applied voltage is too low, the discharge amount is fluctuated (pulsed) synchronously with the frequency. As a result, the thickness of the linear pattern becomes uneven so as to form a lump. Moreover, in the case the frequency is too low or the direct voltage is applied, in general, the liquid tends to be precipitated to the electrode. On the other hand, in the case the frequency of the applied voltage is too high, the liquid cannot follow the changeover of the charge of the applied voltage so that it may be in the same state as in the case of not applying the charge. Moreover, in the case the frequency is too high, in general, the control may be difficult in terms of the performance of the power source. From these view points, the frequency of the applied voltage to the first electrode in the continuous discharge is preferably in a range of 1 Hz to 100 kHz, and from the viewpoint of the discharge continuous property and the voltage control, it is further preferably in a range of 100 Hz to 10 kHz. Moreover, the frequency of the applied voltage to the second electrode is determined optionally according to the frequency of the applied voltage to the above-mentioned first electrode.

(ii) Intermittent Discharge

In the case of the intermittent discharge, the applied voltage may either be of alternative or direct. However, alternative voltage is preferable in terms of the discharge stability. For example, in the case the liquid may be electrodeposited, it is preferable to apply the alternative voltage for the purpose of preventing the electrodeposition. Moreover, in the case of the alternative voltage, it is particularly preferable that the waveform is a rectangular wave.

In the case of carrying out the intermittent discharge, for example, by applying a rectangular wave voltage of 1 kHz at most with the alternative voltage, the discharge can be carried out per dot unit, according to the frequency. It is presumed that the dramatic fluctuation of the electric potential gradation of the liquid, at a drastic changing point of the voltage waveform, provides the discharge driving force. The number of dots per one pulse is basically two for the rectangular wave, such that the discharge is carried out at the times of a rise and a fall of the voltage waveform. However, in the case the frequency is high, the both dots at the rise and fall, of the voltage waveform, may be joined together so as to become one dot.

Figure 7:
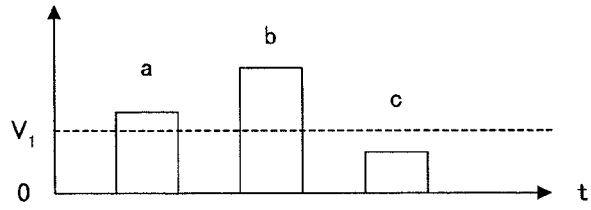
FIG. 7 is a diagram for explaining applied voltage in a case of intermittent discharge.

In the intermittent discharge, there is a threshold value for the voltage intensity. In the example shown in FIG. 7, the liquid is not discharged unless the absolute value of the applied voltage, for here, the electric potential difference between the first electrode and the second electrode, becomes the threshold value V1 or more. Specifically, the discharge is carried out at the times of the pulse a and the pulse b. However, it cannot be carried out at the time of the pulse c. Although the value of the threshold value V1 depends on the discharged liquid or the arrangement of the first electrode and the second electrode, in general, it is preferably in a range of 100 V to 3 kV. Moreover, as in the case of the continuous discharge, since the optimum voltage intensity is varied depending on the aperture diameter of the discharge orifice, the physical properties of the liquid, and the surface state and the material of the substrate, it is preferable to determine the same experimentally beforehand. Accordingly, the discharge amount in the intermittent discharge can be controlled by the voltage intensity.

(2) Arrangement of the Second Electrode

It is preferable that the second electrode in the present embodiment is disposed in between the discharge orifice and the substrate, and that $h<20D$ is satisfied, with the premise that the distance between the second electrode and the discharge orifice is h and the aperture diameter or the aperture width of the discharge orifice, or the diameter of the liquid column of the liquid at the discharge orifice is D. It is more preferable that $h<10D$. In the case the distance h between the second electrode and the discharge orifice is too wide, a high voltage of more than 10 kV is needed for the stable discharge so that the driving will be difficult, and additionally, the risk of the electric discharge, between the second electrode or other portions, is raised.

Moreover, it is preferable that the distance h between the second electrode and the discharge orifice satisfies $h>0.1D$, and it is more preferably $h>D$. In the case the distance h between the second electrode and the discharge orifice is too narrow, the inadvertent electric discharge is easily generated. Moreover, particularly at the time of starting or stopping the discharging operation, the liquid may be adhered to the second electrode inadvertently so as to prevent the accurate discharge.

On the other hand, the distance between the second electrode and the substrate can be set optionally, and thus, it is not particularly limited. However, since it influences the discharge straight-going property and the pattern accuracy, it is preferably set in a range of 0.05 mm to 10 mm, and more preferably in a range of 0.1 mm to 2 mm. In the case the distance between the second electrode and the substrate is too narrow, the discharged liquid may be attracted to the preliminarily discharged liquid on the substrate surface, or to the ruggedness on the substrate surface, etc. so that the effect of stabilizing the liquid discharge can hardly be obtained. Moreover, the electric unstableness due to the surface state of the substrate may be induced. On the other hand, in the case the distance between the second electrode and the substrate is too wide, accuracy of the liquid landing position may be deteriorated.

In the present embodiment, the discharged liquid is adhered onto the substrate surface by passing through the opening for discharge of the second electrode. Therefore, the discharge orifice and the opening for discharge of the second electrode should be disposed such that the discharged liquid can pass through the opening for discharge.

Figure 8:
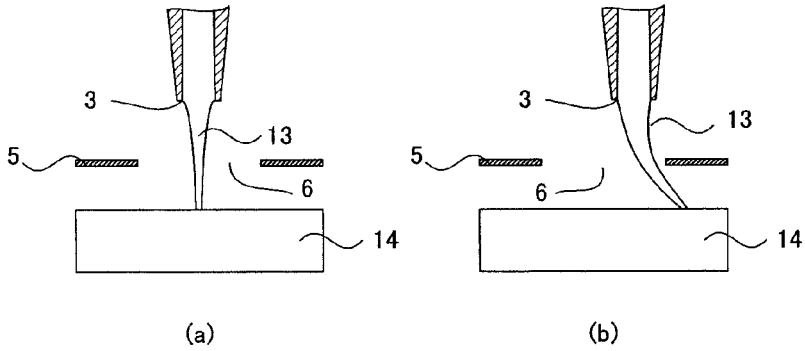
FIG. 8 is a diagram showing a state of a discharge in the present invention.

For example, as shown in FIG. 8A, the second electrode 5 may be disposed such that the central part of the opening for discharge 6 is immediately below the central part of the discharge orifice 3. Thereby, the liquid 13 can be discharged from the discharge orifice 3 onto the substrate 14 in the vertical direction. Moreover, for example as shown in FIG. 8B, the second electrode 5 may be disposed such that the central part of the opening for discharge 6 is extremely offset with respect to the central part of the discharge orifice 3. Thereby, the discharge direction of the liquid 13 can be changed. By utilizing this phenomenon, for example, the liquid can be adhered to the side surface of a concave portion or a convex portion of the substrate having unevenness on the surface, or the liquid can be adhered to the side surface of the substrate.

Accordingly, in the present embodiment, by changing the relative position between the discharge orifice and the opening for discharge of the second electrode, the liquid discharge direction can be controlled.

(3) Discharge

In the present embodiment, in addition to the voltage application between the first electrode and the second electrode, the liquid can also be discharged by controlling the pressure applied to the liquid. That is, in addition to the applied voltage control, also by controlling the pressure applied to the liquid, on/off of the discharge can be controlled. Moreover, by controlling the pressure applied to the liquid, the discharge amount can also be controlled.

In order to control the discharge amount by controlling the pressure applied to the liquid, in addition to the voltage application between the first electrode and the second electrode, the pressurization or the pressure reduction of the liquid is carried out. The promoting force such as the back pressure loaded to the liquid influences the discharge speed, so as to fluctuate the line width of the linear pattern or the dot diameter of the dot line pattern. When the back pressure is made higher, the discharge speed of the liquid discharged form the discharge orifice is made higher, so as to increase the discharge amount per unit time, and the line width or the dot diameter of the discharged liquid is made larger. On the other hand, when the back pressure is lowered, the discharge speed of the liquid discharged form the discharge orifice is made lower, so as to reduce the discharge amount per unit time, and the line width or the dot diameter of the discharged liquid is made smaller. Therefore, the promoting force such as the back pressure is adjusted as needed.

Moreover, as mentioned above, the liquid discharge may either be continuous or intermittent. On/off of the discharge can be carried out, as mentioned above, by the applied voltage change to the first electrode and the second electrode, or furthermore, by the liquid pressure adjustment.

(4) Liquid

It is preferable that the liquid used in the present embodiment has the electric conductivity in a range of $1\times10^{-10}$ to $1\times10^{-4}\ \Omega^{-1}\cdot cm^{-1}$. When the electric conductivity of the liquid is in the above-mentioned range, as the effect by the voltage application, the liquid discharged from the discharge orifice is attracted to the direction of the second electrode and the substrate, so as to be stretched narrowly in the vicinity of the substrate and be adhered stably as a narrow line. That is, in the case the electric conductivity of the liquid is too low, the discharge amount becomes unstable due to the large pulsation so that large liquid droplets are discharged intermittently, and thus, the landing position can hardly be stable. On the other hand, in the case the electric conductivity of the liquid is too high, it can easily be attracted to the preliminarily discharged liquid, to the unevenness on the substrate surface, etc. so that the discharge direction can hardly be stabilized. Moreover, the discharge is likely to be intermittent so that the discharge amount can hardly be stable.

The electric conductivity differs depending on the measurement moment or on the applied voltage frequency. However, the electric conductivity in the present invention refers to the electric conductivity at the frequency of the applied voltage at the time of the discharge.

The above-mentioned liquid conductivity measurement can be carried out by, for example, the following method. Since the liquid in the present embodiment includes an uneven system liquid such as a paste like matters, the electric conductivity is obtained here by using a model in consideration to the capacitor component, in addition to the resistance component.

Figure 9:
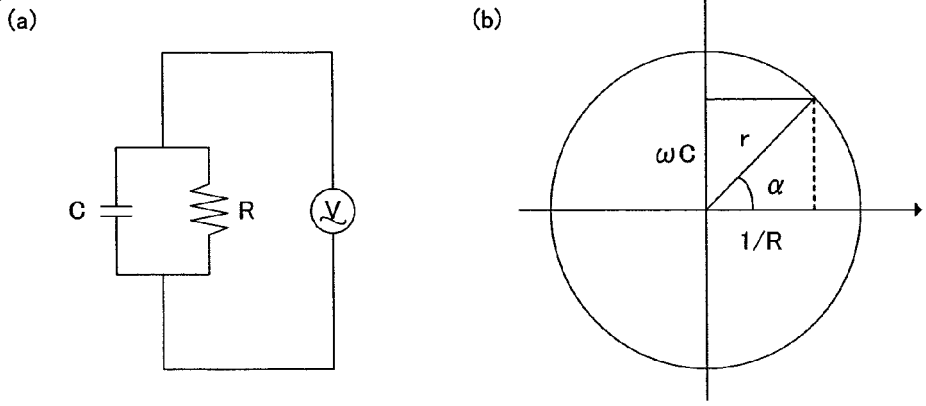
FIG. 9 is a diagram for explaining the measurement principle of the electric conductivity of a liquid.

FIG. 9A shows a parallel circuit model of C and R for calculating the electric conductivity. For the simplification of the measurement and the analysis, when a sine wave is used for the alternative voltage, as the applied voltage, the applied voltage V can be represented as follows.

$$V=V_0\cdot\sin\omega t$$

($V_0$: voltage amplitude, ω: angular frequency, t: time)

Thereby, the electric current ir supplied to the Resistance R can be represented as:

$$ir=V/R=(V_0/R)\sin\omega t.$$

The electric current ic supplied to the capacitor C can be represented as:

$$ic=C(dV/dt)=V_0\cdot\omega\cdot C\cdot\cos\omega t.$$

And the supplied electric current I can be represented as:

$$I=ir+ic=V_0\{(l/R)\sin\omega t+\omega\cdot C\cdot\cos\omega t\}.$$

Here, from $I/V_0=(l/R)\sin\omega t+\omega\cdot C\cdot\cos\omega t$, the electric current I can be rewritten as:

$$I/V_0=\sqrt{\{(l/R^2)+(\omega C)^2\}}\cdot\sin(\omega t+\alpha')$$

$$\alpha'=\tan^{-1}(\omega C/(l/R))=\tan^{-1}(\omega CR)$$

$$\tan\alpha=\omega C/(l/R)=\omega CR$$

(α': phase difference between the voltage V and the electric current I), and it can be represented as FIG. 9B.

Here, r is:

$$r^2=I\max/V_0=l/R^2+(\omega C)^2$$

(Imax: maximum electric current value). Thereby, the resistance R and the capacitor C are:

$$l/R=r\cdot\cos\alpha'$$

$$R=(l/r)\cos\alpha'=(V_0/I\max)\cos 2\pi\alpha f$$

$$\omega C=r'\sin\alpha'$$

$$C=(r/\omega)\sin\alpha'=(I\max/V_0\cdot 2\pi f)\cos 2\pi\alpha f$$

(α: phase difference between the voltage V and the electric current I (measurement value [s]), f: frequency of the applied voltage). Since $V_0$ and f are the measurement conditions, they are known values, and by measuring Imax and α, the resistance R and the capacitor C can be obtained.

Therefore, from the calculated resistance R, the electric conductivity σ can be obtained from:

$$\sigma=l/(R\cdot a)$$

(l: length of the object to be measured, a: area of the object to be measured).

Figure 10:
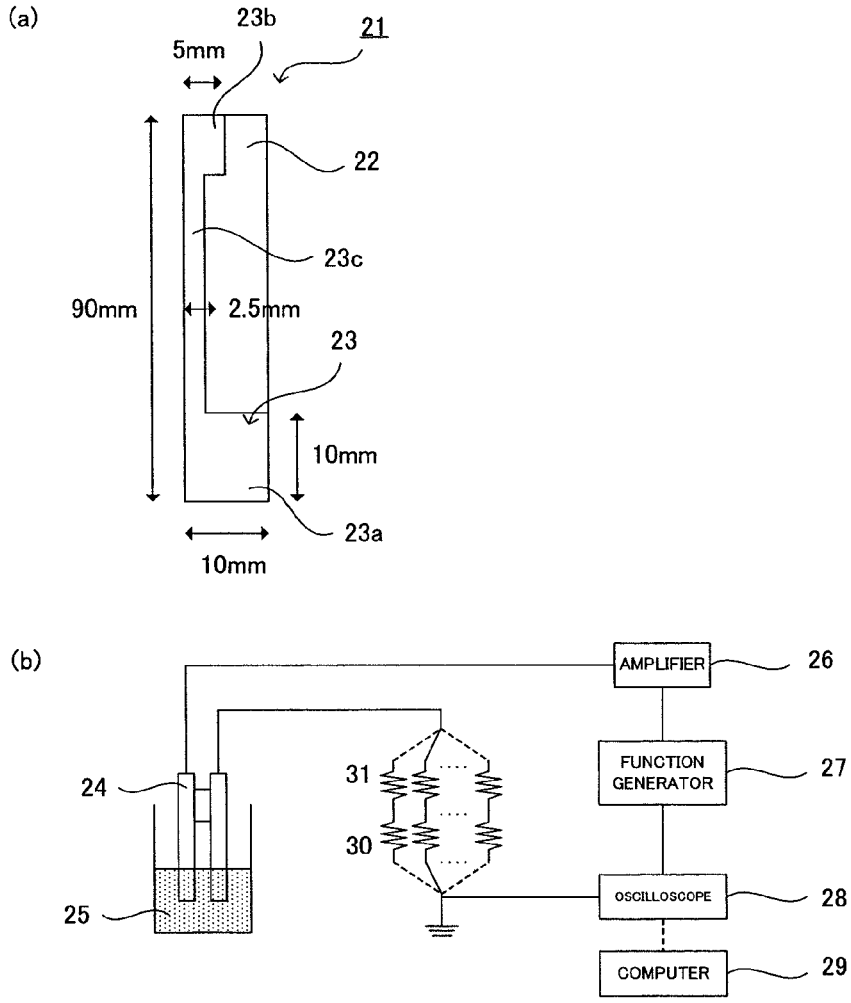
FIG. 10 is a schematic diagram showing an example of a measuring electrode and a measuring device for measuring the electric conductivity of a liquid.

Based on the above-mentioned measurement principle, the electric conductivity can be measured using the following measurement electrode and the measurement device. First, as shown in FIG. 10A, two pieces of ITO glass electrodes 21 are prepared. The ITO glass electrodes 21 comprises a glass substrate 22 of a 10 mm width and a 90 mm length with an ITO electrode 23 formed thereon by the etching process. The ITO electrodes has a pattern of a 10 mm square portion 23*a* on the tip side, a 5 mm square portion 23*b* on the base part side, and a continuously-formed 2.5 mm width portion 23*c* for connecting the sample contact portion and the amplifier contact portion. By disposing the two ITO glass electrodes in parallel, with the ITO portions facing with each other, and by inserting and fixing a 3 mm thickness spacer therebetween, a measurement electrode 24 as shown in FIG. 10B is assembled. Then, the 10 mm square portion 23*a* of the ITO is soaked in a liquid 25 as the sample. It is preferable that the measurement electrode 24 is lowered to the degree that the 10 mm square portion 23*a* of the ITO is just soaked into the sample. In the case the entirety of the 10 mm square portion is not soaked, or the measurement electrode is soaked too deeply, the measurement error becomes large. Moreover, the 5 mm square portion 23*b* of one ITO glass electrode of the measurement electrode is connected to an amplifier 26 and the 5 mm square portion 23*b* of the other ITO glass substrate is connected to a measurement resistance 30.

After setting the measurement electrode 24, the waveform of the applied voltage (sine wave, frequency: 50 Hz) is generated by a function generator 27, and the amplitude and the frequency are adjusted. One of the voltage pulses generated by the function generator 27 is monitored with an oscilloscope 28 and the other one is sent to the amplifier 26. The pulse sent to the amplifier 26 is amplified to about 100 times to 1,000 times so as to be outputted, and applied to the liquid 25 via the measurement electrode 24.

The electric current supplied between the measurement electrodes is observed with the oscilloscope 28 via the measurement resistance 30. The resistance value of the measurement resistance 30 used at the time can be selected according to the liquid. For example, as the resistance to be used, 1Ω, 10Ω, 100Ω, 1 kΩ, 10 kΩ, 100 kΩ, 1 MΩ, or the like can be selected. Moreover, as a protection resistance 31 for protecting the device in the case a large electric current is supplied, ones having a value of about 5 times as much as that of the measurement resistance are used.

The applied voltage waveform and the electric current waveform obtained accordingly on the oscilloscope 28 are analyzed with a computer 29 to obtain the applied voltage, the maximum electric current value, the phase difference for calculating the electric conductivity.

This method is advantageous in that: the measurement electrode can be washed easily owing to its simple structure; the electric conductivity of an optional frequency can be measured; the dielectric constant can be measured at the same time with the electric conductivity; and a wider range of the electric conductivity can be measured by selecting the measurement resistance.

Moreover, the liquid used in the present embodiment is not limited to a liquid of a single phase, but it may be a liquid made of a plurality of phases such as a suspension, a dispersion and an emulsion. For example, since the liquid needs to be in a liquid form (having the flowability) at the discharge temperature, ones having an organic or inorganic solvent, as the main component, and components to be patterned (target substance) dissolved or dispersed therein, according to the usage, can be used. In general, the liquid is made of a composition including a solvent, a binder and a target substance. However, as long as the electric conductivity is in the above-mentioned range, various additives such as a dispersing agent, an antifoaming agent, and an anti sagging agent may be mixed freely, as needed.

In many cases, the electric conductivity of a liquid is determined by the composition of the solvent, which is the main component. By designing the liquid with a solvent having a desired electric conductivity used as the main component, the electric conductivity of the obtained liquid has a value substantially close to the above-mentioned solvent, although it partially depends on the composition.

As the inorganic solvent having the electric conductivity in a range of $1\times10^{-10}$ to $1\times10^{-4}$ $\Omega^{-1}\cdot cm^{-1}$ used in the present embodiment, for example, water, $COCl_2$, HBr, $HNO_3$, $H_3PO_3$, $H_2SO_4$, $SOCl_2$, $SO_2Cl_2$, $FSO_3H$, or the like can be presented.

As the organic solvent having the predetermined electric conductivity, alcohols such as a methanol, a n-propanol, an isopropanol, a n-butanol, a 2-methyl-1-propanol, a tert-butanol, a 4-methyl-2-pentanol, a benzyl alcohol, a α-terpineol, an ethylene glycol, a glycerine, a diethylene glycol, and a triethylene glycol; phenols such as a phenol, a o-cresol, a m-cresol and a p-cresol; ethers such as a dioxane, a fulfural, an ethylene glycol dimethyl ether, a methyl cellosolve, an ethyl cellosolve, a buthyl cellosolve, an ethyl carbitol, a butyl carbitol, a buthyl carbitol acetate and an epichlorohydrin; ketones such as an acetone, a methyl ethyl ketone, a 2-methyl-4-pentanone and an acetophenone; fatty acids such as a formic acid, an acetic acid, a dichloroacetic acid and a trichloroacetic acid; esters such as a methyl formate, an ethyl formate, a methyl acetate, an ethyl acetate, an acetic acid-n-butyl, an isobutyl acetate, an acetic acid-3-methoxybutyl, an acetic acid-n-pentyl, an ethyl propionate, an ethyl lactate, a methyl benzoate, a diethyl malonate, a dimethyl phthalate, a diethyl phthalate, a diethyl carbonate, an ethylene carbonate, a propylene carbonate, an cellosolve acetate, a buthyl carbitol acetate, an ethyl acetoacetate, a methyl cyanoacetate, and an ethyl cyanoacetate; nitrogen containing compounds such as a nitromethane, a nitrobenzene, an acetonitrile, a propionitrile, a succinonitrile, a valeronitrile, a benzonitrile, a nethylamine, a diethyl amine, an ethylene diamine, an aniline, a N-methyl aniline, a N,N-dimethyl aniline, a o-toluidine, a p-toluidine, a pyperidine, a pyridine, an α-picoline, a 2,6-ruthydine, a quinoline, a propylene diamine, a formamide, a N-methyl formamide, a N,N-dimethyl formamide, a N,N-diethyl formamide, an acetoamide, a N-methyl acetoamide, a N-methyl propion amide, a N,N,N',N'-tetramethyl urea, and a N-methylpyrolidone; sulfur containing compounds such as a dimethyl sulfoxide and a sulforan; hydrocarbons such as a benzene, a p-cimene, a naphthalene, a cyclohexyl benzene and a cyclohexene; halogenated hydrocarbons such as a 1,1-dichloroethane, a 1,2-dichloroethane, a 1,1,1-trichloroethane, a 1,1,1,2-tetrachloroethane, a 1,1,2,2-tetrachloroethane, a pentachloroethane, a 1,2-dichloroethylene (cis-), a tetrachloroethylene, a 2-chlorobutane, a 1-chloro-2-methyl propane, a 2-chloro-2-methyl propane, a bromomethane, a tribromomethane and a 1-bromopropane; or the like can be presented.

Figure 11:
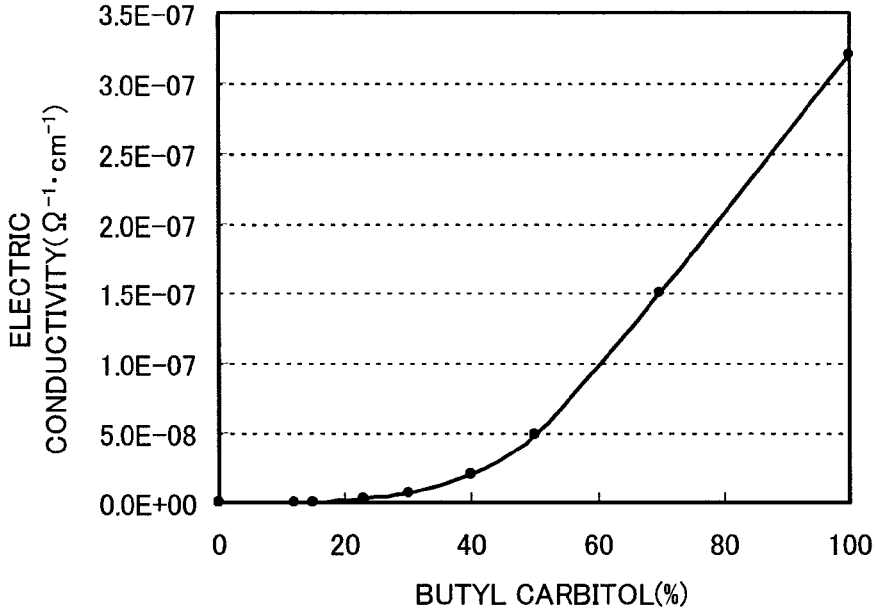
FIG. 11 is a graph showing relationship between the electric conductivity and the composition ratio of a solvent mixture.

In the case there is no solvent having a desired electric conductivity by itself, a mixture of two or more kinds of solvents may be used. For example, in the case a buthyl carbitol having an electric conductivity of $9.6\times10^{-7}$ $\Omega^{-1}\cdot cm^{-1}$ and a buthyl carbitol acetate having an electric conductivity of $3.8\times10^{-9}$ $\Omega^{-1}\cdot cm^{-1}$ are mixed, the electric conductivity changes according to the mixing ratio, as shown in FIG. 11. In the case the electric conductivity of the solvent mixture is desired to be in the vicinity of $1\times10^{-7}\ \Omega^{-1}\cdot cm^{-1}$, from FIG. 11, it is learned that the mixing ratio of the buthyl carbitol and the buthyl carbitol acetate may be 41:59. By dispersing or dissolving a powder or a resin to be patterned in the solvent mixture, in many cases, a liquid having an electric conductivity in the vicinity of $1\times10^{-7}\ \Omega^{-1}\cdot cm^{-1}$ can be obtained.

In the case a desired electric conductivity cannot be obtained only by the solvent, an electric conductivity adjusting substance may be added. As an electric conductivity adjusting substance to raise the electric conductivity by adding, for example, ion compounds including various metal salts such as an alkaline metal salt, an alkaline earth metal salt, a transition metal salt and a rare earth metal salt can be used preferably. Furthermore, it is more preferable that the electric conductivity adjusting substance is one capable of obtaining a high electric conductivity by addition of a smaller amount. For example, a lithium nitrate, a lithium chloride, an ammonium nitrate, or the like can be presented. Moreover, if it is possible, a small amount of water may be added. Addition of a small amount of water promotes dissociation of the electric conductivity adjusting substance so as to dramatically raise the electric conductivity.

Moreover, as the electric conductivity adjusting substance, an acid or an alkaline can be used as well. However, it is necessary to be aware that there is a risk of corroding the constituent members of various kinds of displays, for which the pattern formed body obtained in the present embodiment is used, and that the electric conductivity can hardly be raised compared with the above-mentioned metal salts, or the like.

Among the solvents presented above, those in a solid state under the room temperature can be discharged by supplying the same to the discharge head after being heated to its melting point or higher. Such a method is used commonly in, for example, the hot melt type ink jet method. Although it is disadvantageous in that a heating section needs to be provided in the liquid discharge device and that the warming up time is necessary, it is useful for the application requiring the quick drying property.

The boiling point of the solvent is important because it influences the degree of clogging in the nozzle. The preferable range of the boiling point is 150° C. to 300° C., and it is further preferably 180° C. to 250° C. In the case the boiling point of the solvent is too low, clogging due to drying can easily be generated, but in the case the boiling point of the solvent is too high, the drying operation after the discharge becomes time taking, and thus it is not preferable. It is preferable that such a high boiling point solvent occupies 50% by weight or more of the total solvent component in the liquid, and further preferably 70% by weight or more.

The target substance to be dissolved or dispersed in the solvent is not particularly limited except large particles, which may generate clogging in the nozzle.

In order to form, for example, a colored layer of a color filter for a liquid crystal display, by using the method for manufacturing a pattern formed body of the present embodiment, coloring agents of each color are included in the liquid. And in order to form a black matrix for a liquid crystal display, a black coloring agent is included in the liquid. Moreover, in order to form an electrode, a conductive substance is included in the liquid. Furthermore, in order to form a rib, glass powders are included in the liquid. Still further, in order to form a spacer in a liquid crystal cell, a high viscosity substance and a binder resin are included in the liquid.

As the coloring agent, in general, a common organic pigment or inorganic pigment can be used. Moreover, a so-called processed pigment, of which the surface of a coloring agent is coated with a resin, can also be used. Furthermore, as the coloring agent, a dye may be used. As the dye, an oil soluble dye; a water insoluble dye such as a dispersion dye; a water soluble dye such as a direct dye, an acidic dye, a basic dye, an edible dye, and a reactive dye can be used. These water insoluble dyes and water soluble dyes can be used in a state dispersed or dissolved in an aqueous solvent.

Moreover, in addition to the coloring agent, according to the purpose, various functional materials, such as a magnetic substance, a photoluminescent pigment, a mat pigment, a fluorescent substance, a conductive substance, a ceramic and a precursor thereof, can be mixed and used.

As the fluorescent substance, those commonly known can be used. For example, as a red fluorescent substance, (Y, Gd) $BO_3$:Eu, $YO_3$:Eu, or the like, as the green fluorescent substance, $Zn_2SiO_4$; Mn, $BaAl_{12}O_{19}$:Mn, (Ba, Sr, Mg)O.α-$Al_2O_3$:Mn, or the like, as the blue fluorescent substance, $BaMgAl_{14}O_{23}$:Eu, $BaMgAl_{10}O_{17}$:Eu, or the like can be presented.

As the conductive substance, common electrode materials can be used. For example, metals such as Au, Ta, W, Pt, Ni, Pd, Cr, Cu, Mo, an alkaline metal and an alkaline earth metal; oxides of these metals; alloys such as an Al alloys such as AlLi, AlCa, and AlMg, an Mg alloy such as MgAg, an Ni alloy, a Cr alloy, an alloy of an alkaline metal and an alloy of an alkaline earth metal; conductive inorganic oxides such as an indium tin oxide (ITO), an indium zinc oxide (IZO), an indium oxide and a zinc oxide, or the like can be presented.

In order to firmly bond the above-mentioned target substances, it is preferable to add various kinds of binders. As the binder to be used, for example, celluloses and derivatives thereof such as an ethyl cellulose, a methyl cellulose, a nitro cellulose, a cellulose acetate, and a hydroxylethyl cellulose; an alkyd resin; (meth)acrylic resins and metal salts thereof such as a polymethacrylic acid, a polymethyl methacrylate, a 2-ethyl hexyl methacrylate-methacrylic acid copolymer and a lauryl methacrylate-2-hydroxy ethyl methacrylate copolymer; poly(meth)acrylic amide resins such as a polyN-isopropyl acrylic amide and a polyN,N-dimethyl acrylic amide; styrene based resins such as a polystyrene, an acrylonitrile•styrene copolymer, a styrene•maleic acid copolymer and a styrene•isoprene copolymer; styrene•acrylic resin such as a styrene•n-butyl methacrylate copolymer; various kinds of saturated or unsaturated polyester resins; polyolefin based resins such as a polypropylene; halogenated polymers such as a polyvinyl chloride and a polyvinylidene chloride; vinyl based resins such as a polyvinyl acetate and a vinyl chloride-vinyl acetate copolymer; a polycarbonate resin; an epoxy based resin; a polyurethane based resin; polyacetal resins such as a polyvinyl formal, a polyvinyl butylal and a polyvinyl acetal; polyethylene based resins such as an ethylene-vinyl acetate copolymer, and an ethylene-ethyl acrylate copolymer resin; amide resins such as a benzoguanamine; a urea resin; a melamine resin; a polyvinyl alcohol resin and an anionic cationic modified product thereof; a polyvinyl pyrolidone and a copolymer thereof; a single copolymer, a copolymer and a cross linked product of an alkylene oxide such as a polyethylene oxide and a carboxylated polyethylene oxide; polyalkylene glycols such as a polyethylene glycol, and a polypropylene glycol; a polyether polyol; SBR, NBR latex; a dextrin; a sodium alginate; natural or semi synthetic resins such as a gelatin and a derivative thereof, a casein, a *Hibiscus manihot* L., a tragacanth gum, a pullulan, a gum Arabic, a locust beam gum, a guar gum, a pectin, a carageenan, a glue, an albumin, various kinds of starches, a corn starch, an arum root, a glue plant, an agar, and a soy protein; a terpene resin; a ketone resin; a rosin and a rosin ester; a polyvinyl methyl ether, a polyethylene imine, a polystyrene sulfonic acid, a polyvinyl sulfonic acid, or the like can be used. These resins may be used not only as a homopolymer but also in a state blended with each other in a compatible range.

In the present embodiment, a liquid having a viscosity in a range of 0.1 cps to 1,000,000 cps at the temperature of the discharge can be used. Typically, a liquid having the viscosity in a range of 100 cps to 100,000 cps is used. Moreover, a liquid having the viscosity outside the above-mentioned range can also be used.

Furthermore, it is preferable that the liquid has the photo curing property or the thermosetting property. Thereby, the liquid pattern can easily be fixed after the adhesion of the liquid.

(5) Substrate

The substrate used in the present embodiment is not particularly limited, and not only a simple substrate but also kinds of substances, to which a pattern coating is desired, for example, a back plate of the PDP is included as well. Moreover, the substrate may have a barrier rib formed on its surface as the back plate of the PDP. In the present embodiment, by filling each cell sectioned with the barrier rib, by discharging the liquid thereto, a plurality of patterns sectioned with the cells can be formed.

In the present embodiment, the substrate may in a state of either connected or not connected electrically.

(6) Application

As the applications to which the method for manufacturing a pattern formed body of the present embodiment can be adopted, for example, the following can be presented. As to the display applications, for example, a PDP fluorescent substance, a rib, an electrode, a CRT fluorescent substance, a color filter for a liquid crystal display (RGB colored layers, a black matrix), a micro lens, or the like can be presented. As to the memory and semiconductor applications, for example, a magnetic substance, a ferroelectric substance, a conductive paste (wiring, antenna), or the like can be presented. As to the graphic applications, for example, an ordinary printing, printing to a special medium (film, cloth, steel plate, or the like), curved surface printing, various kinds of printing plates, or the like can be presented. As to the process applications, for example, an adhesive material, a sealing material, or the like can be presented. As to the bio and medical applications, for example, chemical products (those including a plurality of a small amount of components), a gene diagnosis sample, or the like can be presented.

Among these examples, it is preferable that the liquid contains a fluorescent substance and the method for manufacturing a pattern formed body of the present embodiment is used for a PDP panel, an electroluminescent display panel or a field emission display panel. Moreover, it is also preferable that: the liquid contains a coloring agent and the method for manufacturing a pattern formed body of the present embodiment is used for a color filter for a liquid crystal display; the liquid contains a black coloring agent, and the method for manufacturing a pattern formed body of the present embodiment is used for a black matrix for a liquid crystal display; or the liquid contains a conductive substance, and the method for manufacturing a pattern formed body of the present embodiment is used for an electrode.

In particular, the method for manufacturing a pattern formed body of the present embodiment can be used preferably for forming a fluorescent substance for a PDP panel. By discharging a viscous liquid containing a fluorescent substance and having a large solid component concentration onto a substrate in a predetermined pattern, a thick fluorescent substance pattern can be formed.

Moreover, since the liquid discharge amount by the voltage application is minute, the method for manufacturing a pattern formed body of the present embodiment is suitable for forming a minute pattern of about 100 nm to 100 μm. Moreover, since the discharge amount can also be controlled by the voltage intensity or the phase, the method for manufacturing a pattern formed body of the present embodiment is also suitable for the fields requiring the gradation such as the graphic application.

Since the discharge head, the first electrode, the second electrode, or the like will be mentioned in detail in the column of "B. Liquid discharge device" to be described later, explanation is omitted here.

2. Second Embodiment

Next, the second embodiment of the method for manufacturing a pattern formed body of the present invention will be explained. The second embodiment of the method for manufacturing a pattern formed body of the present invention is a method for manufacturing a pattern formed body characterized in that a pattern is formed on a substrate by adhering a liquid, discharged from a discharge orifice of a nozzle of a discharge head, onto the substrate by passing through an opening for discharge of a second electrode, and the liquid discharge amount is controlled by: applying a voltage between a first electrode disposed in the vicinity of the discharge orifice and the second electrode disposed between the discharge orifice and the substrate; and controlling the voltage applied to the first electrode and the second electrode.

The above-mentioned first embodiment is applied for the electric field jet method. However, in the present embodiment, the liquid discharge amount is controlled by controlling the voltage applied to the first electrode and the second electrode, and it can be applied not only to the electric field jet method but also to various common discharging methods such as the ink jet method and the dispenser method.

In the present embodiment, as mentioned in the above-mentioned first embodiment, the electric field influences the discharge amount. Therefore, by controlling the applied voltage to the first electrode and the second electrode, the liquid discharge amount can be controlled.

Since the liquid discharge amount control is the same as that mentioned in the column of the above-mentioned "1. First embodiment (1) Voltage application", explanation is omitted here.

As to the liquid discharging method, common liquid discharging methods can be presented, and for example, the ink jet method, the dispenser method, or the like can be used. In the case of the ink jet method, it may be either of the piezoelectric system or the thermal system. Moreover, the electric field jet method mentioned in the first embodiment can also be used as well.

Moreover, in the present embodiment, for the discharge amount control, the back pressure loaded on the liquid may be adjusted, in addition to the control of the applied voltage to the first electrode and the second electrode.

Although the liquid used in the present embodiment is not particularly limited as long as it is used for a common discharge method and capable of obtaining the above-mentioned effect by the voltage application, it is preferable that the electric conductivity is in a range of $1\times10^{-10}$ to $1\times10^{-4}$ $\Omega^{-1}\cdot cm^{-1}$. In the case the electric conductivity of the liquid is too low, the discharge amount control becomes difficult, and furthermore, with the electric conductivity too high or too low, the liquid landing position is hardly be stable.

Since the electric conductivity measuring method and the electric conductivity adjusting method are the same as those mentioned in the above-mentioned column of "1. First embodiment (4) Liquid", explanation is omitted here.

Moreover, the applications for which the method for manufacturing a pattern formed body of the present embodiment are the same as those mentioned in the above-mentioned first embodiment. At the time, in the case a high viscosity liquid is used, it is preferable to use the electric field jet method.

Since the substrate is the same as that described in the above-mentioned first embodiment, and the discharge head, the first electrode, the second electrode, or the like will be mentioned in detail in the column of "B. Liquid discharge device" to be described later, explanation is omitted here.

3. Third Embodiment

Next, the third embodiment of the method for manufacturing a pattern formed body of the present invention will be explained. The third embodiment of the method for manufacturing a pattern formed body of the present invention provides a method for manufacturing a pattern formed body characterized in that a pattern is formed on a substrate by adhering a liquid, discharged from a discharge orifice of a nozzle of a discharge head, onto the substrate by passing through an opening for discharge of a second electrode, and the liquid discharge amount is controlled by: applying a voltage between a first electrode disposed in the vicinity of the discharge orifice and the second electrode disposed between the discharge orifice and the substrate; and controlling the relative position of the discharge orifice and the opening for discharge of the second electrode.

In the present embodiment, the liquid discharge direction is controlled by controlling the relative position of the discharge orifice and the opening for discharge of the second electrode, and it can be applied not only to the electric field jet method but also to common discharging methods such as the ink jet method and the dispenser method.

In the present embodiment, for example as shown in FIGS. 8A and 8B, by changing the relative position of the central part of the discharge orifice 3 and the central part of the opening for discharge 6 of the second electrode 5, the discharge direction of the liquid 13 can be changed. As shown in FIG. 8A, in the case the central part of the opening for discharge 6 of the second electrode 5 is disposed immediately below the central part of the discharge orifice 3, the discharge direction of the liquid 13 is in the vertical direction from the discharge orifice 3 to the substrate 14. On the other hand, as shown in FIG. 8B, in the case the central part of the opening for discharge 6 of the second electrode 5 is disposed offset with respect to the central part of the discharge orifice 3, the discharge direction of the liquid 13 is in the oblique direction from the discharge orifice 3 to the substrate. Accordingly, by controlling the relative position between the discharge orifice and the opening for discharge of the second electrode, the liquid discharge direction can be controlled.

By utilizing this phenomenon, only by controlling the relative position of the discharge orifice and the opening for discharge of the second electrode, a pattern can be formed on the substrate without moving the substrate or the discharge head.

Moreover, the liquid can be adhered to the side surface of a concave portion or a convex portion of the substrate having unevenness on the surface, or the liquid can be adhered to the side surface of the substrate so that a pattern can be formed at a desired position of the substrate.

Since the positional relationship of the discharge orifice, the second electrode and the substrate is same as that described in the above-mentioned column of "1. First embodiment (2) Arrangement of the second electrode", explanation is omitted here.

Moreover, the applications, for which the method for manufacturing a pattern formed body of the present embodiment is adopted, are the same as those mentioned in the above-mentioned first embodiment. At the time, in the case a high viscosity liquid is used, it is preferable to use the electric field jet method.

Since the liquid discharging method and the liquid are the same as those described in the above-mentioned second embodiment, the substrate is the same as that described in the above-mentioned first embodiment, and the discharge head, the first electrode, the second electrode, or the like will be mentioned in detail in the column of "B. Liquid discharge device" to be described later, explanation is omitted here.

B. Liquid Discharge Device

Next, the liquid discharge device of the present invention will be explained. The liquid discharge device of the present invention comprises: a discharge head having a supply port, a nozzle for discharging a liquid supplied from the supply port from a discharge orifice, and a first electrode disposed in the vicinity of the discharge orifice; a second electrode, disposed with a predetermined gap in the discharge direction of the liquid with respect to the discharge head, having an opening for discharge; a voltage control section for controlling the voltage applied to the first electrode and the second electrode; and a stage, for fixing the substrate, disposed so that the stage is facing to the discharge head, characterized in that the discharge head and the stage can be moved relatively, and the liquid is discharged onto the substrate while applying a voltage between the first electrode and the second electrode, by passing through the opening for discharge of the second electrode.

In the liquid discharge device of the present invention, the liquid discharge can be controlled since the second electrode is disposed with a predetermined gap with respect to the discharge head, in the liquid discharge direction. As the liquid discharge controlling means, there are three embodiments. The first embodiment of the liquid discharge controlling means is a voltage control section which controls the liquid discharge amount by controlling the applied voltage to the first electrode and the second electrode. The second embodiment of the liquid discharge controlling means is the moving means for moving the relative position of the discharge head and the second electrode and this means controls the liquid discharge direction by controlling the relative position of the discharge orifice of the discharge head and the opening for discharge of the second electrode. The third embodiment of the liquid discharge controlling means is the voltage control section which controls on/off of the liquid discharge by applying the voltage between the first electrode and the second electrode.

In the first embodiment, it is preferable that the voltage control section comprises a first voltage control section connected to the first electrode, for controlling the voltage applied to the first electrode, and a second voltage control section connected to the second electrode, for controlling the voltage applied to the second electrode. Thereby, since the applied voltage can optionally be changed by both of the first voltage control section and the second voltage control section, various discharge amount controls are possible.

In the second embodiment, an objective pattern can be formed only by changing the relative position of the discharge orifice and the opening for discharge of the second electrode, and furthermore, a liquid can be adhered onto a desired portion of the substrate.

In the third embodiment, by applying the voltage between the first electrode and the second electrode, the liquid can be discharged from the discharge orifice, and the liquid meniscus can be deformed. Thereby, a minute pattern can be formed.

Accordingly, the liquid discharge device of the present invention enables the control of various liquid discharges.

FIG. 1 schematically shows an example of the liquid discharge device of the present invention. A discharge head 1 comprises a nozzle 2, and a discharge orifice 3 is provided on the tip of the discharge head 1. A storage tank 10 is connected to the discharge head 1, and the storage tank 10 stores a liquid 13 and supplies the same to the discharge head 1. An air pump 12 is connected to the storage tank 10, and the liquid 13 is supplied to the discharge head 1 by applying a pressure to the surface of the liquid 13 in the storage tank 10 by the air supplied from the air pump 12. To the discharge head 1, a pressure control section 11 is connected, and a back pressure P is applied to the surface of the liquid 13 in the discharge head 1 by the air supplied from the pressure control section 11. A first electrode 4 is provided on the inner wall of the nozzle 2 of the discharge head 1. The nozzle 2 is narrowed toward the position of the discharge orifice 3 so as to alleviate the resistance of the liquid at the nozzle. Moreover, a second electrode 5 is disposed in the liquid discharge direction of the discharge head 1. A voltage control section 17 comprises the first voltage control section 8 and the second voltage control section 9. The first voltage control section 8 is connected to the first electrode 4, and the second voltage control section 9 is connected to the second electrode 5. Furthermore, a stage 7 for fixing a substrate 14 is disposed facing to the discharge head 1.

When the stage 7 is moved horizontally by the liquid discharge device, the discharge head 1 reaches at the discharge starting position so as to start the discharge. In the present invention, since the second electrode 5 is disposed with a predetermined gap provided with respect to the discharge head 1 in the liquid 13 discharge direction, stable discharge is always possible regardless of the substrate 14 surface state (a projecting structure such as a rib, a preliminarily formed pattern, a preliminarily discharged liquid, or the like) or the pattern to be formed. Thereby, even in the case the substrate having unevenness on the surface or the substrate having the conductivity difference is used, the liquid can be discharged in the targeted direction without being attracted to the convex portion of the unevenness or the portion having a high conductivity. Moreover, even in the case a subsequent liquid is discharged before drying the preliminarily discharged liquid pattern, the subsequent liquid can be discharged in the targeted direction without being attracted to the prior liquid pattern. Furthermore, a subsequent liquid pattern can be formed accurately adjacent to the prior liquid pattern, in a gap of the prior liquid patterns, or onto the prior liquid pattern.

Although an example of forming a pattern by moving the stage is presented in the above-mentioned explanation, a pattern can be formed by moving the discharge head for scanning. Moreover, an objective pattern can also be formed by moving the second electrode, in a desired direction, with respect to the discharge head instead of moving the discharge head and the stage.

Hereinafter, each configuration of the liquid discharge device of the present invention will be explained.

1. Discharge Head

The discharge head in the present invention comprises a supply port, a nozzle for discharging a liquid supplied from the above-mentioned supply port from a discharge orifice, and a first electrode disposed in the vicinity of the above-mentioned discharge orifice.

Moreover, the discharge head and the stage can be moved relatively. For example, by moving the discharge head in a desired direction, a targeted pattern can be formed. Furthermore, the discharge head and the second electrode can be moved relatively. For example, by moving the second electrode in a desired direction, the liquid discharge direction can be controlled.

Since the liquid discharge direction control is the same as that described in the above-mentioned column of "A. Method for manufacturing a pattern formed body", explanation is omitted here.

The liquid discharge device of the present invention may have only one discharge head, or it may have a plurality of discharge heads. In the case a plurality of discharge heads is provided, the discharging time interval for each discharge head and the distance between the adjacent discharge heads are not particularly limited. Moreover, before drying a liquid discharged by one discharge head, the liquid discharge by other discharge heads may be started. Therefore, liquids of different kinds can be coated substantially simultaneously.

Moreover, the discharge head may have only one nozzle, or it may have a plurality of nozzles. In the case a plurality of nozzles is provided, the distance between the adjacent nozzles is not particularly limited.

Furthermore, the discharging method of the discharge head is not particularly limited. As the discharge head, for example, one for discharging a liquid by the ink jet method of the piezoelectric system or the thermal system, one for discharging a liquid by the dispenser method, one for discharging a liquid by the electric field jet method, or the like can be used. However, as in the above-mentioned third embodiment, in the case of discharging a liquid from the discharge orifice by applying the voltage between the first electrode and the second electrode, a discharge head for discharging a liquid by the electric field jet method is used.

The discharge head may be formed with either a conductive material or an insulating material. The insulating material includes a semiconductor. As the semiconductor material capable of forming the discharge head, for example, a stainless steel, a brass, Al, Cu, Fe, or the like can be used. In the case of using such a semiconductor material, the below-described nozzle itself can act as the first electrode. Moreover, as the insulating material capable of forming the discharge head, for example, the ceramic materials such as a glass, a mica, a zirconium oxide, an alumina, a silicon nitride and an aluminum nitride; the plastic materials such as a polyether ether ketone (PEEK), and an ethylene polyfluorides, or the like can be used.

Hereinafter, each component of the discharge head will be explained.

(1) Nozzle

The nozzle in the present invention is for discharging a liquid, supplied form the supply port, from the discharge orifice. The discharge can be carried out by applying the voltage to the liquid by: constituting the nozzle itself with an electrode material; disposing the first electrode on the inner wall of the nozzle; disposing the first electrode inside the channel which is not in contact with the nozzle inner wall; disposing the first electrode outside the nozzle; or embedding the first electrode within the nozzle wall.

The shape of the discharge orifice is not particularly limited, and it may either be a hole-like shape or a slit-like shape.

In the case the discharge orifice is the hole-like shape, the hole-like shape may be round, polygonal, or the like. The aperture diameter of the hole-like shape discharge orifice is preferably in a range of 5 to 2,000 μm, and it is further preferably in a range of 10 to 1,000 μm in terms of the meniscus stability and the clog prevention. Moreover, although it depends on the liquid to be discharged, the aperture diameter is preferably selected in a range of ½ times to 50 times with respect to the width of the discharged pattern.

On the other hand, in the case the discharge orifice is the slit-like shape, as in the case of the aperture diameter of the hole-like shape discharge orifice, the aperture width of the slit-like shape discharge orifice is preferably in a range of 5 to 2,000 μm, and it is further preferably in a range of 10 to 1,000 μm in terms of the meniscus stability and the clog prevention.

Figure 12:
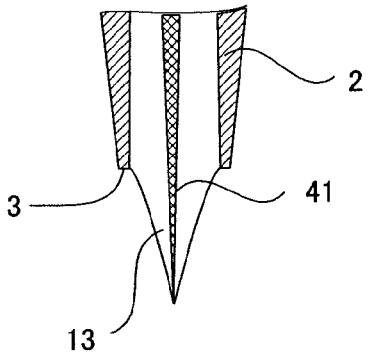
FIG. 12 is a schematic diagram showing an example of a nozzle.

Moreover, for example as shown in FIG. 12, in the nozzle, a needle-like member 41 may be disposed at the central part of the nozzle 2 and the discharge orifice 3, in the vertical direction with respect to the substrate. In this case, while contacting the liquid 13 to the surface of the needle-like member 41, the liquid 13 is discharged from the tip thereof. The needle-like member 41 projecting to the tip promotes the meniscus deformation of the liquid 13 so as to stabilize the starting of the discharge.

Although the needle-like member is shown in FIG. 12, it may be a rod-like member. Among the rod-like shape, since a sharpened tip is preferable for promoting the meniscus deformation, the needle-like member is preferable. On the other hand, in the case of the rod-like member without the sharpened tip, the tip diameter is preferably 1,000 μm or less, and it is further preferably 100 μm or less.

Moreover, as the material for forming the needle-like member or the rod-like member, for example, a metal, an insulating material, or the like can be presented.

The material for forming the nozzle is not particularly limited. However, for example, a conductive material and an insulating material can be presented. Here, the insulating materials include semiconductor material. As the conductive material for forming the nozzle, for example, a stainless steel, a brass, Al, Cu, Fe, or the like can be presented. Moreover, as the insulating material for forming the nozzle, for example, the ceramic materials such as a glass, a mica, a zirconium oxide, an alumina, and a silicon nitride; the plastic materials such as a PEEK, a fluorine resin, and a polyamide, or the like can be presented.

It is preferable that the tip surface of the nozzle is coated with a fluorine resin, etc., which has a low surface free energy so as to prevent spreading of the liquid. In the case the liquid is spread, the meniscus formation at the discharge orifice becomes instable, and furthermore, the liquid remains as the pollution at the time of the discharge stoppage so as to pose the adverse effect to the subsequent discharge.

In the case the first electrode is disposed outside the nozzle, the thickness of the nozzle wall is preferably in a range of 1 to 1,000 μm.

(2) First Electrode

The first electrode in the present invention is disposed in the vicinity of the discharge orifice. As mentioned above, the embodiment of the first electrode may be any one of (1) constituting the nozzle itself with an electrode material, (2) disposing the first electrode on the inner wall of the nozzle, (3) disposing the first electrode inside the channel which is not in contact with the nozzle inner wall, (4) disposing the first electrode outside the nozzle, (5) embedding the first electrode within the nozzle wall, or the like.

In the case of the above-mentioned (2) to (5), the distance between the discharge orifice and the first electrode relates to the size of the necessary voltage. However, it can be selected freely in an extremely wide range. For example, when a sufficiently large voltage is provided, although it depends on the discharge speed, the discharge can be carried out even when the first electrode is away from the discharge orifice by 10 cm or more. From the viewpoint of the necessary applied voltage intensity, the distance between the discharge orifice and the first electrode is preferably 30 mm or less, and it is further preferably 10 mm or less. Such degree of freedom of the first electrode disposing will be a significant advantage in designing of the discharge head.

When the conductivity of the liquid is high, or when a plurality of nozzles is arranged as an array and different signals are imparted to the adjacent nozzles, in order to inhibit an electric discharge or a cross talk, the distance between the discharge orifice and the first electrode is preferably 0.05 mm or more, and more preferably in a range of 0.1 mm to 10 mm, and further preferably in a range of 0.15 mm to 5 mm.

The material for forming the first electrode is not particularly limited. However, for example, metals such as Au, Ag, Cu, and Al; alloys such as a stainless steel and a brass; conductive ceramics such as a ITO; or the like can be used preferably. In the case the first electrode is disposed inside the channel, for the purpose of preventing the denaturizing and the wear of the first electrode, coating such as a hard coating may be applied to the first electrode surface.

2. Second Electrode

The second electrode used in the present invention is disposed with a predetermined gap with respect to the discharge head in the liquid discharge direction, and it has an opening for discharge.

As the shape of the second electrode, round, polygonal, or the like can be presented, and it can be selected optionally according to the purpose.

Figure 13:
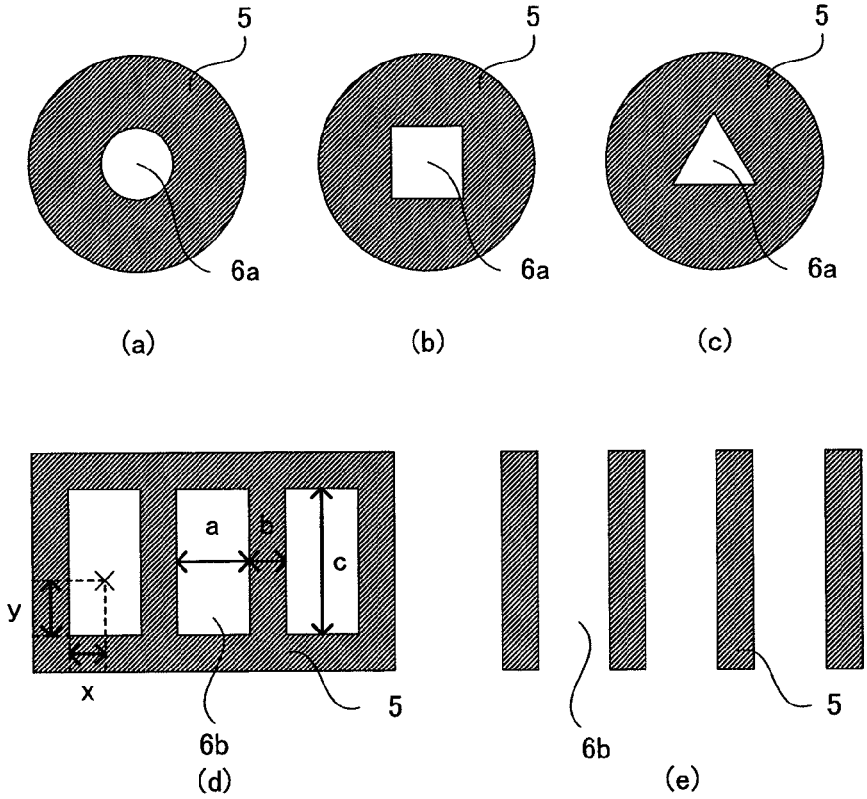
FIG. 13 is a schematic diagram showing an example of a second electrode.

As the opening for discharge of the second electrode, for example, round or polygonal through holes 6*a* as shown in FIGS. 13A to 13C, slits 6*b* as shown in FIGS. 13D, 13E, or the like can be presented. Although the second electrode 5 has one through hole 6*a* in FIGS. 13A to 13C, the through hole may be provided in a plurality.

In the present invention, since the discharged liquid generates the attracting force with respect to the second electrode, in the case the opening for discharge is a through hole, the shape of the through hole is preferably a shape that the liquid is not eccentrically attracted to a part of the second electrode when the liquid passes through the opening for discharge of the second electrode. In the case the discharged liquid is eccentrically attracted to a part of the second electrode, the liquid discharge stability is deteriorated so that the liquid cannot be adhered onto a targeted position. Specifically, it is preferable that the through hole shape is line symmetrical, and it has at least two symmetric axes.

The minimum diameter of the opening for discharge of the second electrode (maximum diameter of a circle to be accommodated in the opening for discharge) r can be selected optionally according to the distance h between the second electrode and the discharge orifice, the kind of the liquid, the aperture diameter of the discharge orifice, the targeted size, or the like. However, it is preferable that $D/2<r<20D$ is satisfied, with the premise that the aperture diameter or the aperture width of the discharge orifice, or the diameter of the liquid column of the liquid at the discharge orifice is D. In the case r is too small, a risk that the liquid is inadvertently adhered to the second electrode will be high, particularly at the time of starting or stopping the discharge. Once the liquid is adhered to the second electrode, control of the discharge amount or the discharge direction thereafter becomes extremely difficult. On the other hand, in the case r is too large, the contribution of the second electrode will be small so that, as in the case there is no second electrode, the discharge state may be changed according to the substrate surface state, since the electric field between the substrate and the first electrode provides the discharge driving force.

Moreover, in the case a plurality of nozzles is disposed adjacently, it is preferable that the second electrode, which is disposed corresponding to the discharge orifice of each nozzle, is sectioned corresponding to the nozzle. Moreover, in the case different signals are sent to the adjacent nozzles, the second electrode corresponding to each nozzle should be independent electrically as well.

Moreover, it is preferable that the second electrode and the discharge head can be moved relatively. Thereby, the liquid discharge direction can be controlled. Since the control of the liquid discharge direction is the same as that described in the above-mentioned column of "A. Method for manufacturing a pattern formed body", explanation is omitted here.

As the material for forming the second electrode, the same materials can be used as for the above-mentioned first electrode. In particular, in terms of the processing suitability and the cost, metals are used preferably.

Moreover, since the second electrode needs to be fixed standing by itself, deformation such as deflection should not be generated, even if the second electrode is supported by one point. For the purpose of increasing the strength, ones, of which an electrode pattern is formed on the surface of an insulating member such as a ceramic, and a plastic, may be used as well.

In the case the second electrode is disposed corresponding to a plurality of nozzles, as the second electrode, ones, of which a plurality of electrode patterns are formed on a highly insulating member such as a polyimide, can be used preferably.

Moreover, the adhesion of the discharged liquid to the second electrode should be avoided as much as possible. Therefore, it is preferable that the surface of the second electrode is covered with a fluorine resin, etc., which has a low surface free energy.

3. Voltage Control Section

The voltage control section in the present invention is for controlling the voltage applied between the first electrode and the second electrode. In the present invention, by controlling the applied voltage to the first electrode and the second electrode by this voltage control section, the liquid discharge amount can be controlled. Moreover, by applying the voltage between the first electrode and the second electrode by the voltage control section, on/off of the liquid discharge can be controlled.

It is preferable that the voltage control section comprises: a first voltage control section connected to the first electrode, which controls the voltage applied to the first electrode; and a second voltage control section connected to the second electrode, which controls the voltage applied to the second electrode. The first voltage control section and the second voltage control section each comprises, for example, a pulse generator and a power source. Thereby, the voltage intensity, the frequency, the phase, or the like of the applied voltage can be set appropriately. By changing the voltage intensity, the frequency, the phase, or the like of the applied voltage, the liquid discharge amount or on/off of the liquid discharge can be controlled.

Since the applied voltage control, the liquid discharge amount control, on/off control of the liquid discharge, or the like are the same as those described in the above-mentioned column of "A. Method for manufacturing a pattern formed body", explanation is omitted here.

4. Stage

The stage in the present invention is disposed facing to the discharge head, and is for fixing the substrate. The discharge head and the stage can be moved relatively so that, for example, by moving the discharge head in a desired direction, a purposed pattern can be formed.

The stage is not particularly limited as long as it can fix the substrate.

5. Others

The liquid discharge device of the present invention may have a pressure control section for controlling the pressure applied to the liquid. By applying the pressure to the liquid by the pressure control section, in addition to the voltage application, on/off of the discharge, or the discharge amount can be controlled.

The pressure control section may be disposed in the discharge head, or it may be connected to the discharge head. As the pressure control section disposed in the discharge head, for example, a syringe, a piston, or a heater in the ink jet method of the thermal system, a piezoelectric element in the ink jet method of the piezoelectric method, or the like can be presented. Moreover, as the pressure control section connected to the discharge head, for example, an air pump or the like can be presented.

Moreover, in the present invention, the storage tank for supplying the liquid to the supply port of the discharge head may be connected to the supply port of the discharge head.

The present invention is not limited to the above-mentioned embodiments. The above-mentioned embodiments are merely examples, and anyone having the substantially same configuration and exhibiting similar function and effect as the technological idea described in the claims of the present invention is included in the technological scope of the present invention.

EXAMPLES

Hereinafter, the present invention will be explained specifically with reference to the examples.

Examples 1

An example of forming a fluorescent substance for a plasma display panel will be described.

(1) Preparation of a Green Fluorescent Substance Paste

First, the following components were introduced into a container having a thermal reflux mechanism by the following ratio, were agitated and dissolved at 60° C. for 12 hours, and then, cooled down to the room temperature so as to prepare a green resin solution.

| (Composition of the green resin solution) | |
|---|---|
| Ethyl cellulose (STD-200, manufactured by The Dow Chemical Company): | 3.0 parts by weight |
| Ethyl cellulose (STD-4, manufactured by The Dow Chemical Company): | 18.2 parts by weight |
| Buthyl carbitol (manufactured by Daicel Chemical Industries, Ltd.): | 39.4 parts by weight |
| Benzyl alcohol (manufactured by KANTO CHEMICAL CO., INC.): | 16.9 parts by weight |
| Terpineol (manufactured by YASUHARA CHEMICAL CO., LTD.): | 22.5 parts by weight |

Then, a green fluorescent substance and a solvent were further added to the above-mentioned green resin solution by the following ratio. After kneading the same with a double planetary mixer, it was processed with a three-roll mill for three times. By filtrating the obtained dispersion through a 500 mesh, a green fluorescent substance paste was obtained. The viscosity of the obtained green fluorescent substance paste was 183 poise at 23.0° C., and the electric conductivity was $2.2\times10^{-7}\ \Omega^{-1}\cdot cm^{-1}$.

| (Composition of the green fluorescent substance paste) | |
|---|---|
| Green resin solution: | 47.8 parts by weight |
| Green fluorescent substance (manufactured by KASEI OPTONIX, LTD.): | 36.0 parts by weight |
| 3-methoxy butyl acetate (manufactured by Daicel Chemical Industries, Ltd.): | 7.0 parts by weight |
| Propylene glycol n-butyl ether (Danowal PnB, manufactured by The Dow Chemical Company): | 8.1 parts by weight |
| Diacetone alcohol (manufactured by JUNSEI CHEMICAL CO., LTD.): | 1.1 parts by weight |

(2) Preparation of a Red Fluorescent Substance Paste

First, with the following components by the following ratio, a red resin solution was prepared by the same method as in the green resin solution of the above-mentioned example.

| (Composition of the red resin solution) | |
|---|---|
| Ethyl cellulose (STD-200, manufactured by The Dow Chemical Company): | 4.5 parts by weight |
| Ethyl cellulose (STD-4, manufactured by The Dow Chemical Company): | 11.2 parts by weight |
| Buthyl carbitol (manufactured by Daicel Chemical Industries, Ltd.): | 42.2 parts by weight |
| Benzyl alcohol (manufactured by KANTO CHEMICAL CO., INC.): | 18.1 parts by weight |
| Terpineol (manufactured by YASUHARA CHEMICAL CO., LTD.): | 24.1 parts by weight |

Then, a red fluorescent substance, a solvent and an electric conductivity adjusting substance were further added to the above-mentioned red resin solution by the following ratio. By the same method as in the above-mentioned green fluorescent substance paste, a red fluorescent substance paste was prepared. The electric conductivity adjusting substance was added for adjusting the electric conductivity difference with respect to the above-mentioned green fluorescent substance paste. Here, for the large electric conductivity rising ratio and the easy thermal decomposition removal after coating, an ammonium nitrate was selected. The viscosity of the obtained red fluorescent substance paste was 104 poise at 23.0° C., and the electric conductivity was $6.3\times10^{-6}\ \Omega^{-1}\ cm^{-1}$.

| (Composition of the red fluorescent substance paste) | |
|---|---|
| Red resin solution: | 40.3 parts by weight |
| Red fluorescent substance (manufactured by KASEI OPTONIX, LTD.): | 45.0 parts by weight |
| 3-methoxy butyl acetate (manufactured by Daicel Chemical Industries, Ltd.): | 6.3 parts by weight |
| Propylene glycol n-butyl ether (Danowal PnB, manufactured by The Dow Chemical Company): | 7.3 parts by weight |
| Diacetone alcohol (manufactured by JUNSEI CHEMICAL CO., LTD.): | 1.0 part by weight |
| Ammonium nitrate (manufactured by KANTO CHEMICAL CO., INC.): | 0.1 part by weight |

(3) Preparation of a Blue Fluorescent Substance Paste

First, the following components were mixed by the following ratio and a blue resin solution was prepared by the same method as in the green resin solution of the above-mentioned example.

| (Composition of the blue resin solution) | |
|---|---|
| Ethyl cellulose (STD-200, manufactured by The Dow Chemical Company): | 4.7 parts by weight |
| Ethyl cellulose (STD-4, manufactured by The Dow Chemical Company): | 11.7 parts by weight |
| Buthyl carbitol (manufactured by Daicel Chemical Industries, Ltd.): | 41.8 parts by weight |
| Benzyl alcohol (manufactured by KANTO CHEMICAL CO., INC.): | 17.9 parts by weight |
| Terpineol (manufactured by YASUHARA CHEMICAL CO., LTD.): | 23.9 parts by weight |

Then, a blue fluorescent substance, a solvent and an electric conductivity adjusting substance were further added to the above-mentioned blue resin solution by the following ratio. By the same method as in the above-mentioned green fluorescent substance paste, a blue fluorescent substance paste was prepared. Furthermore, in addition to the electric conductivity adjusting substance, a dimethyl sulfoxide was added for adjusting the electric conductivity difference with respect to the above-mentioned red fluorescent substance paste. Since the dimethyl sulfoxide promotes the ionization of the electric conductivity adjusting substance, the electric conductivity is further increased. The viscosity of the obtained blue fluorescent substance paste was 107 poise at 23.0° C., and the electric conductivity was $1.5\times10^{-5}\ \Omega^{-1}\cdot cm^{-1}$.

| (Composition of the blue fluorescent substance paste) | |
|---|---|
| Blue resin solution: | 42.6 parts by weight |
| Blue fluorescent substance (manufactured by KASEI OPTONIX, LTD.): | 40.0 parts by weight |
| 3-methoxy butyl acetate (manufactured by Daicel Chemical Industries, Ltd.): | 6.6 parts by weight |
| Propylene glycol n-butyl ether (Danowal PnB, manufactured by The Dow Chemical Company): | 7.6 parts by weight |
| Diacetone alcohol (manufactured by JUNSEI CHEMICAL CO., LTD.): | 1.0 part by weight |
| Ammonium nitrate (manufactured by KANTO CHEMICAL CO., INC.): | 0.2 part by weight |
| Dimethyl sulfoxide (manufactured by KANTO CHEMICAL CO., INC.): | 2.0 parts by weight |

(4) Discharge of the Fluorescent Substance Paste

To the back plate of the plasma display panel, that is, into the stripe shaped cells provided on the surface of the substrate, the fluorescent substance pastes were discharged in order of red, green and blue.

The size of the barrier rib for sectioning the stripe shaped cells was 0.14 mm height, 0.30 mm pitch width, 0.10 mm base portion width, and 0.06 mm top portion width.

The discharge head has a plurality of nozzles with a plurality of discharge orifices disposed in a row horizontally for each of the red, green and blue fluorescent substance pastes, and the specification of the discharge orifice was as follows.

Aperture diameter: 500 μm

Aperture pitch: 900 μm

Aperture depth (length of the portion narrowed to the aperture diameter at the nozzle tip): 100 μm Number of the discharge orifices: 340

Material: macerite

As the second electrode, one having a rectangular slit corresponding to the discharge orifice provided in a 1 mm thickness stainless steel plate as shown in FIG. 13D was used. The size of the slit was: the aperture width a=0.5 mm; the aperture pitch b=0.4 mm; and the aperture length c=6 mm. Moreover, the distance between the discharge orifice and the second electrode was 200 μm. The position was adjusted so that the central part of the discharge orifice is at the point of x=0.25 mm, y=1.5 mm.

The operation conditions of the liquid discharge device were as follows:

Substrate scanning speed; 70 mm/sec

Distance between the second electrode and the substrate; 500 μm

Relative position of the discharge orifice and the cell; It was adjusted such that the central part of the discharge orifice coincides with the central part of the target cell Coating order; in the order of green, red and blue The distance between each discharge head for the red, green and blue fluorescent substance pastes; 80 mm The applied voltage to the first electrode; for the green fluorescent substance paste, a rectangular wave of $V_{p-p}$=7 kV, f=800 Hz, for the red fluorescent substance paste, a rectangular wave of $V_{p-p}$=5 kV, f=1.5 kHz, and for the blue fluorescent substance paste, a rectangular wave of $V_{p-p}$=4 kV, f=4 kHz The applied voltage to the second electrode; 0 V for the red, green and blue fluorescent substance pastes Head backpressure; It was adjusted such that the discharged fluorescent substance paste can fill the target cell by 100%

(5) Drying

The substrate after coating the fluorescent substance paste was dried in an oven of 80° C. for 60 minutes so as to form a fluorescent substance of a PDP panel.

(6) Evaluation

According to the observation of each cell with a laser microscope, immediately after coating the red, green and blue fluorescent substance pastes on the substrate, all of each fluorescent substance paste was filled in a predetermined cell, and a portion, of which the paste is filled across the adjacent cells, was not observed. Moreover, according to the observation of the fluorescent substance of the PDP panel, obtained by drying, with a black light directed from above, splashes or color mixture of the colors was not observed.

Comparative Example 1

In the same manner as in the example 1 except that the second electrode was not used and that the distance between the discharge orifice and the substrate was 400 μm, a fluorescent substance for a PDP panel was formed.

(Evaluation)

According to the observation as in the example 1 with the black light directed to the fluorescent substance of the PDP panel from above, the second color green fluorescent substance paste and the third color blue fluorescent substance paste were filled into the cells for red color, not being filled into the predetermined cells.

Example 2

An example of forming a colored layer of a color filter for a liquid crystal display is described. Here, a wettability variable pattern, comprising a liquid repellent region and a lyophilic region, was formed on a substrate surface by using a photocatalyst, so that the each color ink dose not flow out of the region to be patterned.

(1) Preparation of a Photocatalyst Containing Layer Forming Coating Solution

By mixing the following components and agitating the same at 100° C. for 20 minutes, a photocatalyst containing layer forming coating solution was prepared.

| (Composition of the photocatalyst containing layer forming coating solution) | |
|---|---|
| Isopropyl alcohol: | 3 g |
| Fluoroalkyl silane (manufactured by JEMCO Inc., MF-160E: 50% by weight isopropyl ether solution of a N-[3-(trimethoxysilyl)propyl]-N-ethyl perfluorooctane sulfonamide): | 0.07 g |
| Titaniumoxidesol (manufactured by ISHIHARA SANGYO KAISHA, LTD., STK-01): | 3 g |
| Silica sol (manufactured by Nihon Gosei Gomu Co., Gurasuka HPC 7002): | 0.6 g |
| Alkyl alkoxy silane (manufactured by Nihon Gosei Gomu Co., HPC 402C): | 0.2 g |

(2) Formation of a Photocatalyst Containing Layer

The above-mentioned photocatalyst containing layer forming coating solution was coated onto a soda glass transparent substrate having a black matrix, comprising a chromium thin film pattern of a 76 μm×259 μm pitch and a 23 μm line width, by a spin coater. After a drying process at 150° C. for 10 minutes, by promoting the hydrolysis and the polycondensation reaction, a 0.5 μm thickness transparent photocatalyst containing layer, with the photocatalyst firmly fixed in an organo polysiloxane, was formed.

A light beam was irradiated to the photocatalyst containing layer via a mask with a mercury lamp (wavelength 365 nm) by a 70 mW/cm$^2$ luminosity for 3 minutes, and the contact angle with respect to water, of the non-irradiated portion and the irradiated portion, was measured. Using a contact angle measuring device (CA-Z type manufactured by Kyowa Interface Science, Co., Ltd.), the contact angle was measured after 30 seconds after dropping water droplets from a micro syringe onto the non-irradiated portion or the irradiated portion. As a result, the contact angle with respect to water of the non-irradiated portion was 70°, whereas the contact angle with respect to water of the irradiated portion was 10° or less. It was confirmed that, since the irradiated portion becomes a highly hydrophilic, a pattern can be formed utilizing the wettability difference between the irradiated portion and the non-irradiated portion.

Furthermore, using the standard liquid shown in the wettability test defined in the JIS K6768, the contact angle (θ) after 30 seconds after contacting the liquid droplets to the non-irradiated portion of the surface of the photocatalyst containing layer was measured. A Jisman plot (lateral axis: surface tension of the standard liquid, vertical axis: cos θ) was produced and a graph was inserted thereto. The surface tension of the point whose cos θ=0, that is, the critical surface tension of the non-irradiated portion was 30 mN/m. In the same manner, the critical surface tension of the irradiated portion was measured and it was 70 mN/m.

(3) Exposure of the Photocatalyst Containing Layer

After disposing a mask, having a light shielding pattern of a 76 μm×259 μm pattern pitch and a width (10 μm) narrower than the line width of the above-mentioned black matrix (23 μm), onto the photocatalyst containing layer on the above-mentioned transparent substrate and positioning the same so as to be superimposed on the black matrix, the photocatalyst containing layer was exposed via the mask with a mercury lamp (wavelength 365 nm) by a 70 mW/cm$^2$ luminosity for 50 seconds. Thereby, the irradiated portion was made to be highly hydrophilic. The irradiated portions were sectioned by the 10 μm width non-irradiated portion existing on the black matrix so as to have a 76×259 μm size pixel part forming region, surrounded by the black matrix, and a region superimposed on the black matrix surrounding the same.

(4) Preparation of a Colored Layer Forming Ink

Out of the following components, first, the pigment, the polymer dispersing agent and the solvent were mixed, and by using a three rolls and a bead mill, a pigment dispersion was obtained. While sufficiently agitating the pigment dispersion with a dissolver, or the like, the other materials were added gradually by a small amount so as to prepare a red colored layer forming ink.

| (Composition of a red colored layer forming ink) | |
|---|---|
| Pigment (C.I. Pigment red 254): | 10 parts by weight |
| Polymer dispersing agent (Solspace 24000 manufactured by Avecia Limited): | 2 parts by weight |
| Binder (glycidyl methacrylate-styrene copolymer)] | 6 parts by weight |
| First epoxy resin (novolak type epoxy resin, Epicoat 154 manufactured by Japan Epoxy Resins Co., Ltd.): | 4 parts by weight |
| Second epoxy resin (neopentyl glycol diglycidyl ether): | 10 parts by weight |
| Curing agent (trimellitic acid): | 8 parts by weight |
| Solvent (3-ethyl ethoxy propionate): | 60 parts by weight |

Furthermore, a green colored layer forming ink was prepared in the same manner as in the case of the red colored layer forming ink except that the same amount of C. I. Pigment green 36 was used instead of the C. I. Pigment red 254 in the above-mentioned composition. Furthermore, a blue colored layer forming ink was prepared in the same manner as in the case of the red colored layer forming ink except that the same amount of C. I. Pigment blue 15:6 was used instead of the C. I. Pigment red 254 in the above-mentioned composition.

(5) Production of a Color Filter

The above-mentioned red, green blue colored layer forming inks were coated onto a predetermined position on the transparent substrate provided with the above-mentioned photocatalyst containing layer. The discharge head has a plurality of nozzles with a plurality of discharge orifices disposed in a row horizontally foe each of the red, green and blue colored layer forming inks, and the specification of the discharge orifice was as follows:

Aperture diameter; 100 μm

Aperture pitch; 228 μm

Aperture depth (length of the portion narrowed to the aperture diameter at the nozzle tip); 100 μm Number of the discharge orifices; 300

Material; macerite

As the second electrode, one having a round through hole corresponding to the discharge orifice provided in a mm thickness stainless steel plate was used. The diameter of the through hole was 0.1 mm. The position was adjusted such that the central part of the discharge orifice coincides with the central part of the round through hole. The distance between the discharge orifice and the second electrode was 150 μm.

The operation conditions of the liquid discharge device were as follows:

Substrate scanning speed; 40 mm/sec

Distance between the second electrode and the substrate; 300 μm

Relative position between the discharge orifice and the pixel part forming region; It was adjusted such that the central part of the discharge orifice coincides with the central part of the target pixel part forming region Coating order; in the order of red, green and blue The distance between each discharge head for the red, green and blue colored layer forming inks; 80 mm The applied voltage to the first electrode; for the red, green and blue colored layer forming inks, a rectangular wave of $V_{p\text{-}p}$=2.5 kV, f=700 Hz The applied voltage to the second electrode; for the red, green and blue colored layer forming inks, a rectangular wave of $V_{p\text{-}p}$=1 kV, f=700 Hz of the phase opposite to that of the first electrode Head back pressure; It was adjusted such that the dry film thickness of the discharged colored layer forming ink becomes 2 μm The discharged red, green and blue colored layer forming inks were accurately landed on a desired position, and furthermore, they were repelled by the non-irradiated portion on the black matrix by the function of the photocatalyst containing layer so as to be dispersed evenly on the pixel part forming region.

Thereafter, after vacuum drying the transparent substrate after coating the colored layer forming inks at 80° C. for 3 minutes, it was heated at 200° C. for 60 minutes in an oven so as to be cured and a colored layer was formed.

Then, by coating a two component-mixing type thermosetting agent (SS7265 produced by Nihon Gosei Gomu Co.) onto the colored layer by a spin coater, and subjecting to a curing process at 200° C. for 30 minutes, a protection layer was formed so as to produce a color filter.

Comparative Example 2

A color filter was produced in the same manner as in the example 2 except that the second electrode was not used and that the distance between the discharge orifice and the transparent substrate was 250 μm.

Even though the photocatalyst containing layer was used in the same manner as in the example 2, the second color green colored layer forming ink and the third color blue colored layer forming ink were coated on the first color red colored layer forming ink, not landing on a predetermined position.

What is claimed is:

1. A liquid discharge device comprising: a discharge head having a supply port, a nozzle for discharging a liquid supplied from the supply port from a discharge orifice, and a first electrode disposed in the vicinity of the discharge orifice; a second electrode, disposed with a predetermined gap in a liquid discharge direction of the liquid with respect to the discharge head, having an opening for discharge defined in a surface of the second electrode; a voltage control section for controlling the voltage applied to the first electrode and the second electrode; and a stage, for fixing the substrate, disposed so that the stage is facing to the discharge head, wherein the opening for discharge defined in the surface of the second electrode has a structure which is configured to provide a uniform potential around a circumference of the opening for discharge defined in the surface of the second electrode, the discharge head and the stage is moved relatively, the liquid is discharged onto the substrate while applying a voltage between the first electrode and the second electrode, by passing through the opening for discharge of the second electrode, and the discharge direction of the liquid is changed by changing the relative position of a central part of the discharge orifice of the discharge head in a direction parallel to a plane of the second electrode and the substrate, relative to a central part the opening for discharge of the second electrode.

2. The liquid discharge device according to claim 1, wherein the voltage control section comprises: a first voltage control section connected to the first electrode, which controls the voltage applied to the first electrode; and a second voltage control section connected to the second electrode, which controls the voltage applied to the second electrode, and the liquid discharge amount is controlled by controlling the voltage applied to the first electrode and the second electrode.

3. The liquid discharge device according to claim 1, wherein the voltage control section discharges a liquid from the discharge orifice by applying a voltage between the first electrode and the second electrode.

4. The liquid discharge device according to claim 1, comprising a pressure control section for controlling the pressure applied to the liquid.

* * * * *